US008547308B2

(12) United States Patent
Iida et al.

(10) Patent No.: US 8,547,308 B2
(45) Date of Patent: Oct. 1, 2013

(54) DISPLAY DEVICE, DRIVING METHOD THEREOF, AND ELECTRONIC APPARATUS

(75) Inventors: Yukihito Iida, Kanagawa (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 87 days.

(21) Appl. No.: 13/067,274

(22) Filed: May 20, 2011

(65) Prior Publication Data

US 2011/0227897 A1 Sep. 22, 2011

Related U.S. Application Data

(63) Continuation of application No. 11/878,513, filed on Jul. 25, 2007, now Pat. No. 7,986,285.

(30) Foreign Application Priority Data

Jul. 27, 2006 (JP) ..... 2006-204056

(51) Int. Cl.
*G09G 3/30* (2006.01)

(52) U.S. Cl.
USPC ..... 345/76; 345/80; 315/169.3

(58) Field of Classification Search
USPC ..... 345/76–83; 315/169.3
See application file for complete search history.

(56) References Cited

U.S. PATENT DOCUMENTS 5,990,629 A 11/1999 Yamada et al.
6,380,689 B1 * 4/2002 Okuda ..... 315/169.3
6,734,636 B2 * 5/2004 Sanford et al. ..... 315/169.3
6,750,833 B2 * 6/2004 Kasai ..... 345/76
7,071,932 B2 7/2006 Libsch et al.
7,109,952 B2 9/2006 Kwon
7,274,345 B2 9/2007 Imamura et al.
7,317,433 B2 * 1/2008 Chen et al. ..... 345/76
7,499,042 B2 3/2009 Shirasaki et al.
7,515,121 B2 4/2009 Sato et al.
7,518,393 B2 * 4/2009 Shirasaki et al. ..... 324/760.01

(Continued)

FOREIGN PATENT DOCUMENTS

JP 2003-255856 A 9/2003
JP 2003-271095 A 9/2003

(Continued)

OTHER PUBLICATIONS

Japanese Office Action issued Feb. 14, 2012 for corresponding Japanese Application No. 2006-204056.

*Primary Examiner* — Dmitriy Bolotin
(74) *Attorney, Agent, or Firm* — Rader, Fishman & Grauer PLLC

(57) ABSTRACT

A display device comprises a pixel array unit including a plurality of pixels, and power supply lines and a power supply scanner for supplying a power supply voltage switching between first and second potentials to each of the power supply lines, wherein each of the pixels includes a light emitting element, a sampling transistor, a driver transistor, and a holding capacitor. The sampling transistor samples a signal potential to be held in the holding capacitor, the driver transistor receives a supply of a current from the power supply scanner through the power supply line at a first potential and flows a drive current to the light emitting element in accordance with the held signal potential, and the power supply scanner changes the power supply line from the first potential to the second potential before the sampling transistors samples the signal potential.

8 Claims, 27 Drawing Sheets

(56) References Cited

U.S. PATENT DOCUMENTS

| | | | | |
|---|---|---|---|---|
| 7,525,522 | B2 | 4/2009 | Iida et al. | |
| 7,843,234 | B2 | 11/2010 | Srinivas et al. | |
| 7,898,507 | B2 | 3/2011 | Takei et al. | |
| 8,072,399 | B2 * | 12/2011 | Iida et al. | 345/77 |
| 8,089,430 | B2 * | 1/2012 | Ilda et al. | 345/76 |
| 8,390,543 | B2 * | 3/2013 | Iida et al. | 345/77 |
| 2003/0048248 | A1 | 3/2003 | Fukumoto et al. | |
| 2004/0113873 | A1 | 6/2004 | Shirasaki et al. | |
| 2004/0263443 | A1 | 12/2004 | Shirasaki | |
| 2005/0157581 | A1 | 7/2005 | Shiurasaki et al. | |
| 2005/0206590 | A1 | 9/2005 | Sasaki et al. | |
| 2005/0225518 | A1 | 10/2005 | Yamada et al. | |
| 2005/0269959 | A1 * | 12/2005 | Uchino et al. | 315/169.3 |
| 2007/0115225 | A1 | 5/2007 | Uchino et al. | |
| 2008/0030436 | A1 | 2/2008 | Iida et al. | |
| 2008/0030437 | A1 | 2/2008 | Iida et al. | |
| 2008/0238830 | A1 | 10/2008 | Iida et al. | |
| 2010/0156860 | A1 | 6/2010 | Yamamoto et al. | |

FOREIGN PATENT DOCUMENTS

| | | | |
|---|---|---|---|
| JP | 2004-029791 | A | 1/2004 |
| JP | 2004-093682 | A | 3/2004 |
| JP | 2004-133240 | A | 4/2004 |
| JP | 2004-295131 | A | 10/2004 |
| JP | 2007-310311 | A | 11/2007 |
| JP | 2008-032863 | A | 2/2008 |
| WO | WO-2006/060902 | A1 | 6/2006 |

* cited by examiner

DISPLAY DEVICE, DRIVING METHOD THEREOF, AND ELECTRONIC APPARATUS

CROSS REFERENCES TO RELATED APPLICATIONS

This is a Continuation Application of the patent application Ser. No. 11/878,513, filed Jul. 25, 2007, which claims priority from Japanese Patent Application No. 2006-204056 filed in the Japanese Patent Office on Jul. 27, 2006, the entire content of which are incorporated herein by reference.

BACKGROUND OF THE INVENTION

1. Field of the Invention

The present invention relates to an active matrix type display device using light emitting elements as pixels and a driving method thereof. The present invention relates also to an electronic apparatus in which this type of display device is assembled.

2. Description of Related Art

The development of emissive, flat panel display devices using an organic electroluminescent (EL) device as an optical emitting element has been made vigorously in recent years. An organic EL device is a device utilizing a phenomenon in which as an electric field is applied to an organic thin film, light emission occurs. Since the organic EL device is driven by an application voltage of 10 V or lower, the device consumes a low power. Since the organic EL device is an emissive device which emits light by itself, no illumination member is required and the device can be made light in weight and thin easily. Furthermore, a response time of the organic EL device is very fast, at about several μs, so that an afterimage does not occur during the display of moving images.

Among flat panel emissive type display devices using organic EL devices as pixels, active matrix type display devices integrating a thin film transistor in each pixel have been developed vigorously. Active matrix type, flat panel emissive display devices are described, for example, in the following Patent Documents 1 to 5.

Japanese Patent Application Publication No. 2003-255856 (Patent Document 1)

Japanese Patent Application Publication No. 2003-271095 (Patent Document 2)

Japanese Patent Application Publication No. 2004-133240 (Patent Document 3)

Japanese Patent Application Publication No. 2004-029791 (Patent Document 4)

Japanese Patent Application Publication No. 2004-093682 (Patent Document 5)

However, current-technology active matrix type, flat panel emissive display devices have a variation in threshold voltages and mobilities of transistors for driving light emitting elements due to process variations. The characteristics of an organic EL device are subject to a secular change. A variation in the characteristics of driver transistors and a change in the characteristics of organic EL devices affect an emission luminance. In order to control an emission luminance uniformly over the whole screen of a display device, a change in the characteristics of transistors and organic EL devices are required to be corrected in each pixel circuit. A display device provided with a correction function has been proposed. However, the proposed pixel circuit provided with the correction function requires a wiring for supplying an electrical potential for correction, switching transistors, and switching pulses, resulting in a complicated pixel circuit. Since there are many constituent elements of a pixel circuit, these elements hinder a high precision display.

SUMMARY OF THE INVENTION

One advantage of the present invention is that there is provided a display device capable of realizing high precision by simplifying a pixel circuit and the driving method. Specifically, an improved display device and a driving method thereof are provided, which stabilizes a correction function for threshold voltages without being adversely affected by the wiring capacitance and resistance of a pixel circuit.

One embodiment provides a display device comprising: a pixel array unit including a plurality of pixels, and power supply lines; and a power supply scanner for supplying a power supply voltage switching between first and second potentials to each of the power supply lines, wherein each of the pixels includes a light emitting element, a sampling transistor, a driver transistor, and a holding capacitor, wherein the sampling transistor samples a signal potential to be held in the holding capacitor, the driver transistor receives a supply of a current from the power supply scanner through the power supply line at a first potential and flows a drive current to the light emitting element in accordance with the held signal potential, the power supply scanner changes the power supply line from the first potential to the second potential before the sampling transistors samples the signal potential.

Another embodiment provides a method comprising: sampling, by the sampling transistor, a signal potential to be held in the holding capacitor; receiving, by the driver transistor, a supply of a current from the power supply scanner through the power supply line at a first potential; flowing, by the driver transistor, a drive current to the light emitting element in accordance with the held signal potential; and changing, by the power supply scanner, the power supply line from the first potential to the second potential before the sampling transistors samples the signal potential.

In another embodiment, in an active matrix type display device using light emitting elements, such as organic EL devices, as pixels, each pixel has a threshold value correction function of the driver transistor. Preferably, each pixel also has a mobility correction function, a secular variation correction function (bootstrap operation) of an organic EL device and other functions. A current-technology pixel circuit having the correction functions of this type has a large layout area because of a number of constituent elements, so that the pixel circuit is not suitable for a high precision display. According to an embodiment of the present invention, switching pulses are used as a power supply voltage to be supplied to each pixel, thereby reducing the number of constituent elements. By using switching pulses as the power supply voltage, a switching transistor for threshold voltage correction and a scan line for scanning the gate of the switching transistor may become unnecessary. Accordingly, constituent elements of the pixel circuit and wirings can be reduced considerably and a pixel area can be reduced to realize a high precision display.

In order to correct a threshold voltage of a driver transistor, in one embodiment, the gate and source potentials of the driver transistor may be reset in advance. In an embodiment, by adjusting the timings when the source and gate potentials of the driver transistor are reset, a threshold voltage correction operation can be executed reliably. More specifically, when the gate potential of the driver transistor is reset to the reference potential and the source potential is set to the second potential (low level of a power supply potential), the power supply line is dropped beforehand to the second potential. In this manner, the threshold voltage correction operation can be executed reliably without being affected by the wiring capacitance and the resistance. As has been described, the display device of an embodiment of the present invention operates without being affected by the wiring capacitance of the pixel circuit so that the embodiment can be applied to a high precision and large screen display device.

DETAILED DESCRIPTION OF EMBODIMENTS

Figure 1:
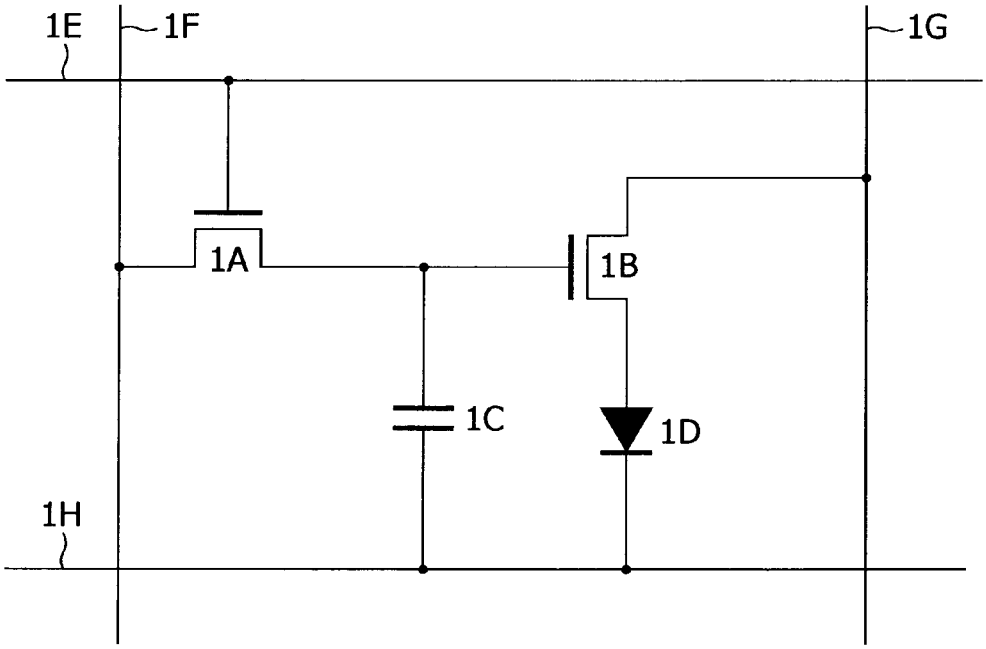
FIG. 1 is a circuit diagram showing a general pixel structure.

Embodiments of the present invention now will be described in detail with reference to the accompanying drawings. First, in order to make it easy to understand an embodiment of the present invention and clarify the background, the general structure of a display device will be described briefly with reference to FIG. 1. FIG. 1 is a schematic circuit diagram showing one pixel of a general display device. As shown in FIG. 1, this pixel circuit has a sampling transistor 1A disposed at a cross point of a scan line 1E and a signal line 1F disposed orthogonally. The sampling transistor 1A is an n-type. The gate of the transistor 1A is connected to the scan line 1E and the drain of the transistor 1A is connected to the signal line 1F. One electrode of a holding capacitor 1C and a gate of a driver transistor 1B are connected to the source of the sampling transistor 1A. The driver transistor 1B is an n-type. The drain of the driver transistor 1B is connected to a power supply line 1G and the source of the driver transistor 1B is connected to an anode of a light emitting element 1D. The other electrode of the holding capacitor 1C and a cathode of the light emitting element ID are connected to a ground wiring 1H.

Figure 2:
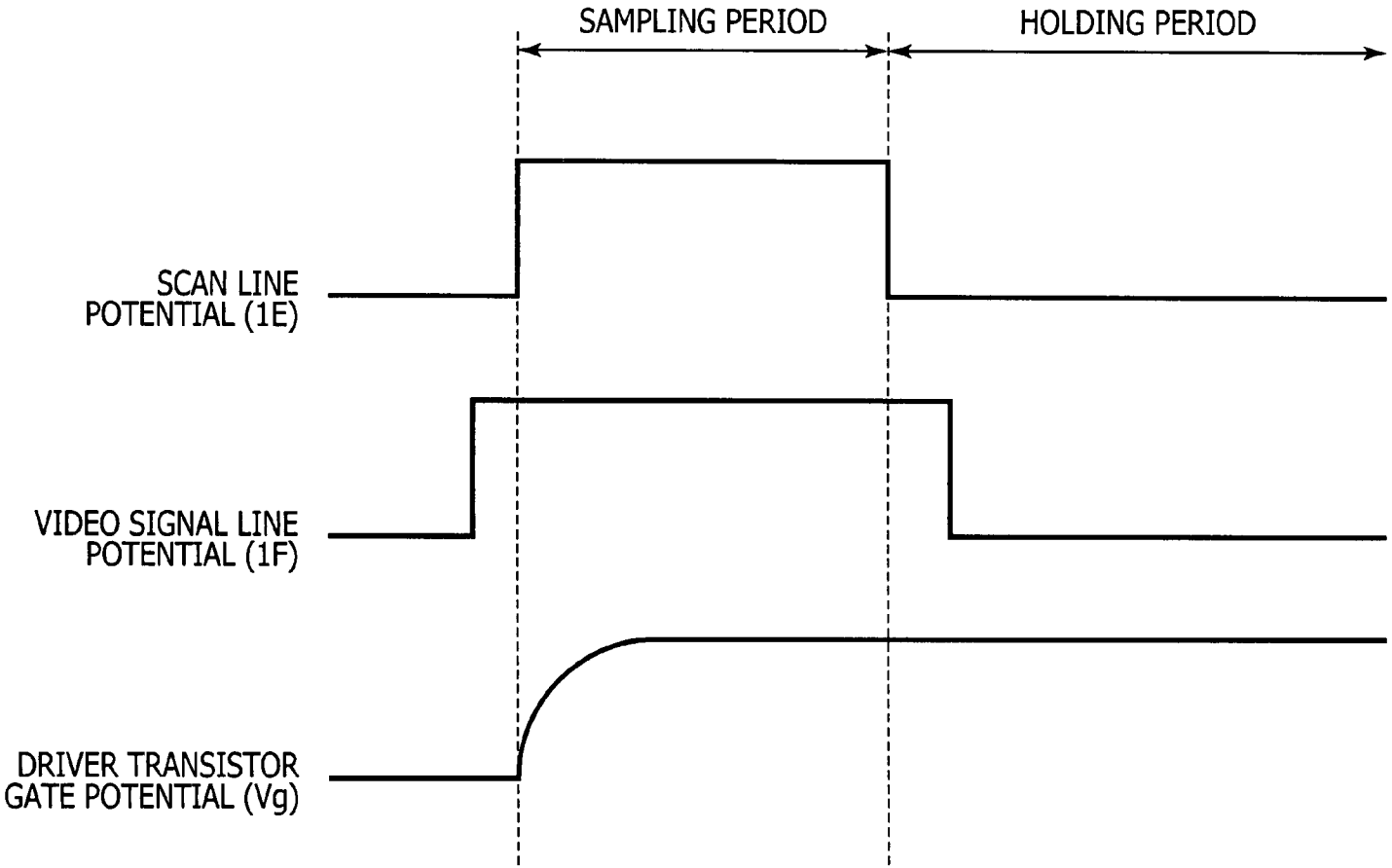
FIG. 2 is a timing chart illustrating the operation of the pixel circuit shown in FIG. 1.

FIG. 2 is a timing chart illustrating the operation of the pixel circuit shown in FIG. 1. This timing chart illustrates an operation of sampling a potential of a video signal (video signal line potential), supplied from the signal line (1F) and making the light emitting element 1D made of an organic EL device or the like enter an emission state. By transiting a potential of the scan line (1E) (scan line potential) to a high level, the sampling transistor (1A) turns to an on-state to charge the video signal potential in the holding capacitor (1C). The gate potential (Vg) of the driver transistor (1B) therefore starts rising to start flowing a drain current. Thus, the anode potential of the light emitting element (1D) rises to start light emission. Thereafter, as the scan line potential transits to a low level, the video signal potential is held in the holding capacitor (1C), and the gate potential of the driver transistor (1B) becomes constant so that the emission luminance is maintained constant until the next frame.

However, due to manufacturing variations of the driver transistor (1B), each pixel has a change in the characteristics, such as a threshold voltage and a mobility. Because of the variation in characteristics, even if the same gate potential is applied to the driver transistor (1B), a drain current (driver current) of each pixel varies, so that a variation of emission luminances appears. Furthermore, due to a secular change in the characteristics of the light emitting element (1D) made of an organic EL device or the like, the anode potential of the light emitting element (1D) varies. A variation in anode potentials appears as a change of a gate-source voltage of the driver transistor (1B), thereby causing a variation of drain currents (driver currents). A variation in driver currents due to these various causes appears as a variation in emission luminances of pixels, thereby deteriorating the image quality.

Figure 3A:
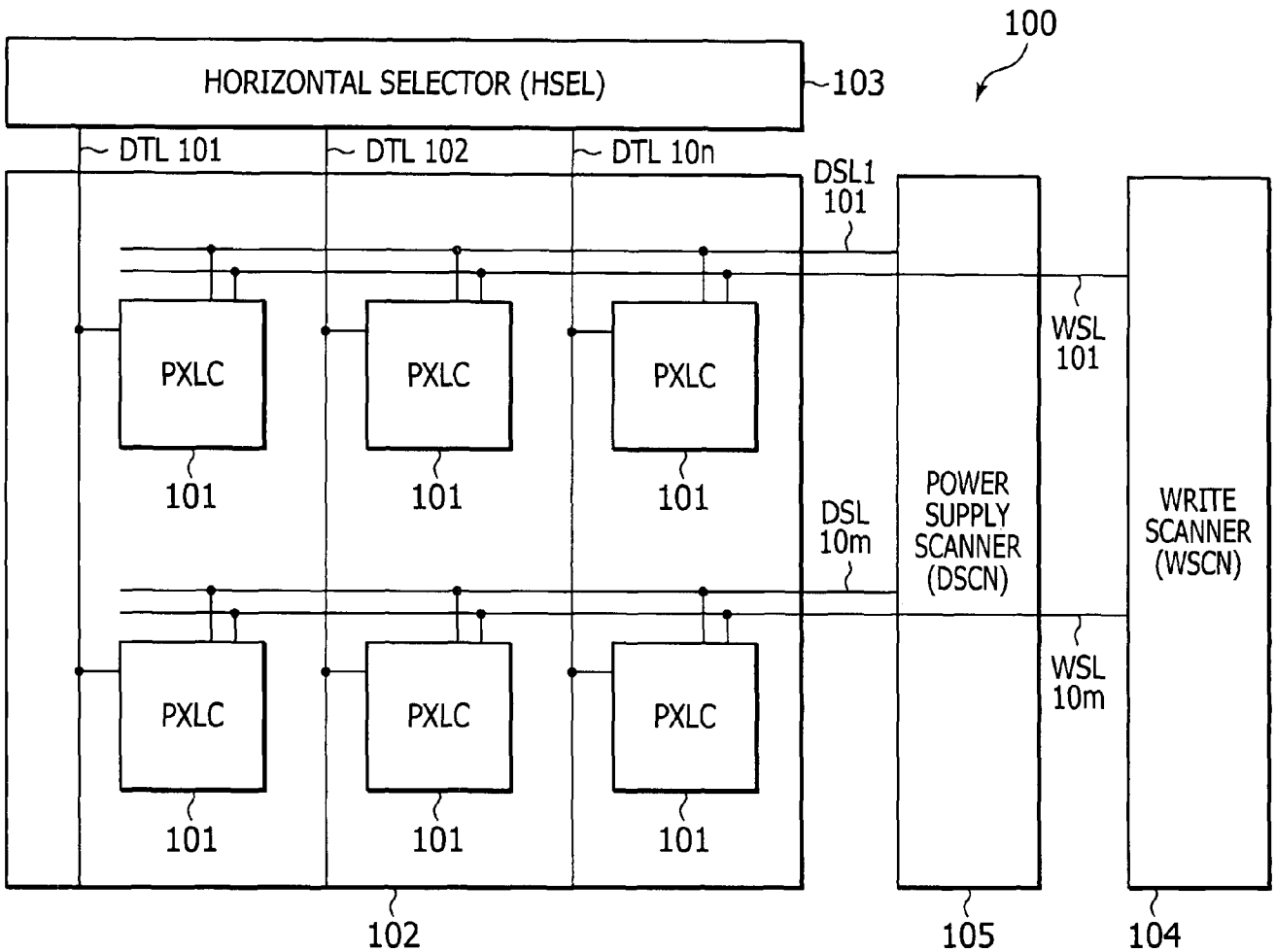
FIG. 3A is a block diagram showing the whole structure of a display device according to an embodiment of the present invention.
Figure 3B:
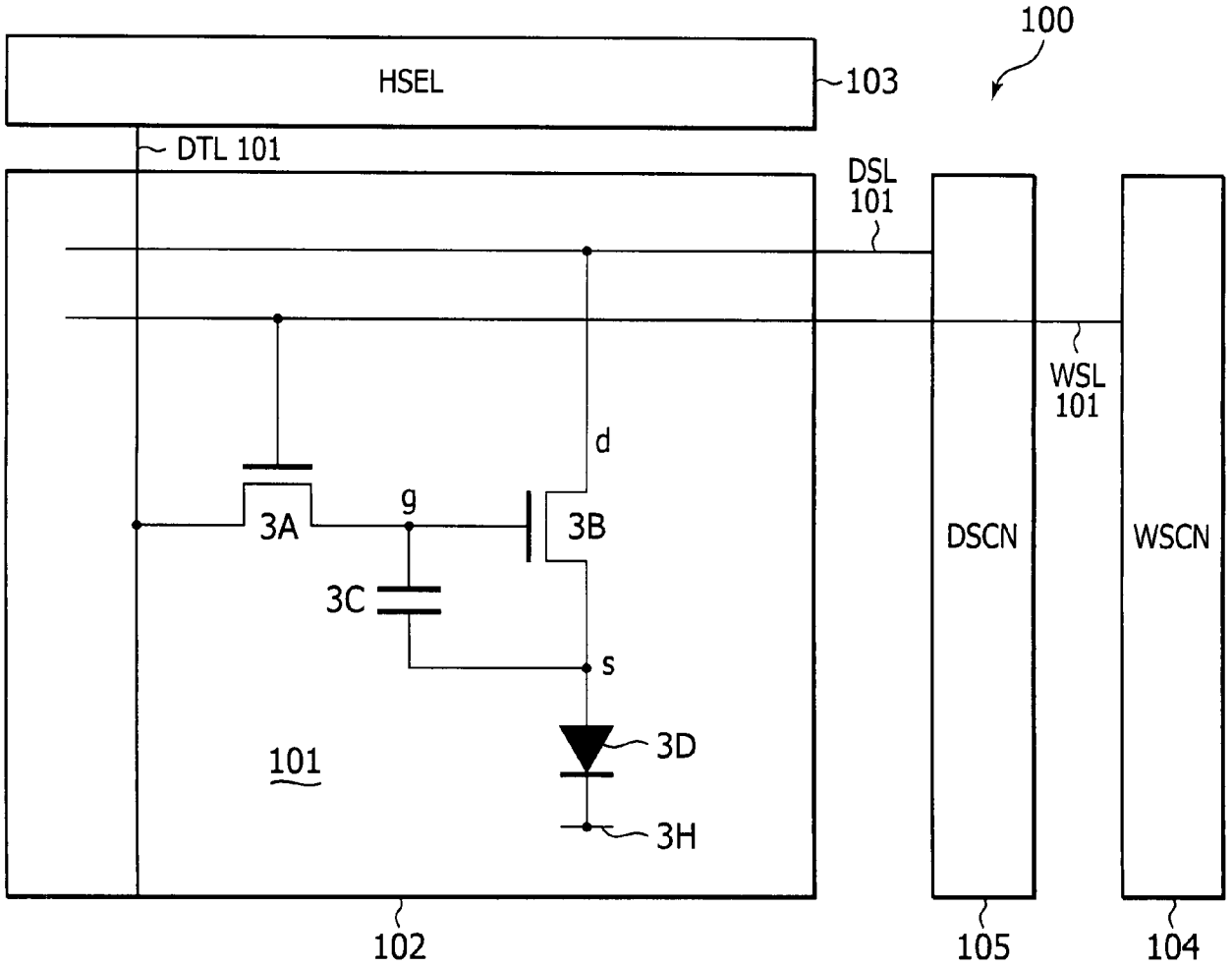
FIG. 3B is a circuit diagram of a display device according to an embodiment of the present invention.

FIG. 3A is a block diagram showing the whole structure of a display device of an embodiment of the present invention. As shown in FIG. 3A, the display device 100 is constituted of a pixel array unit 102 and a driver unit (103, 104 and 105) for driving the pixel array unit. The pixel array unit 102 is constituted of row scan lines WSL101 to 10*m*, column signal lines DTL101 to 10*n*, matrix pixels (PXLC) 101 disposed at cross points of the scan and signal lines, and power supply lines DSL101 to 10*m* disposed at each row of the pixels 101. The driver unit (103, 104 and 105) is composed of a main scanner (write scanner WSCN) 104, a power supply scanner (DSCN) 105, and a signal selector (horizontal selector HSEL) 103. The main scanner 104 sequentially supplies a control signal to each of the scan lines WSL101 to 10*m* to perform line sequential scanning in the row unit. The power supply scanner 105 supplies, synchronously with the line sequential scanning, a power supply voltage switching between first and second potentials to each power supply line DSL 101 to 10*m*. The signal selector 103 supplies, synchronously with the line sequential scanning, a signal potential and a reference potential to the column signal lines DTL 101 to 10*n*. The signal potential forms a video signal FIG. 3B is a circuit diagram showing the specific structure and wiring relation of the pixel 101 in the display device 100 shown in FIG. 3A. As shown, the pixel 101 has a light emitting element 3D typically made of an organic EL device, a sampling transistor 3A, a drive transistor 3B and a holding capacitor 3C. A gate of the sampling transistor 3A is connected to a corresponding scan line WSL101, one of the source and the drain is connected to a corresponding signal line DTL101, and the other is connected to a gate g of the driver transistor 3B. One of the source s and the drain d of the driver transistor 3B is connected to the light emitting element 3D, and the other is connected to a corresponding power supply line DSL101. In this embodiment, the drain d of the driver transistor 3B is connected to the power supply line DSL101, and the source s is connected to an anode of the light emitting element 3D. A cathode of the light emitting element 3D is connected to a ground wiring 3H. The ground wiring 3H is wired in common to all the pixels 101. The holding capacitor 3C is connected across the source s and gate g of the driver transistor 3B.

In the circuit structure described above, the sampling transistor 3A becomes conductive in response to a control signal supplied from the scan line WSL101, and samples the signal potential supplied from the signal line DTL101 to hold the sampled signal potential in the holding capacitor 3C. The driver transistor 3B is supplied with current from the power supply line DSL101 at a first potential, and flows a drive current to the light emitting element 3D in accordance with the signal potential held in the holding transistor 3B. Before the sampling transistor 3A samples the signal potential, the power supply scanner 105 changes the power supply line DSL101 from the first potential to a second potential at a first timing. The main scanner 104 makes the sampling transistor 3A conductive at a second timing after the first timing to apply the reference potential from the signal line DTL101 to the gate g of the driver transistor 3B and set the source s of the driver transistor 3B to the second potential. The power supply scanner 105 changes the power supply line DSL101 from the second potential to the first potential at a third timing after the second timing, to hold a voltage corresponding to a threshold voltage Vth of the driver transistor 3B in the holding capacitor 3C. With this threshold voltage correction function, the display device 100 can cancel the influence of the threshold voltage of the driver transistor 3B having a variation among pixels. In addition, the power supply scanner 105 adjusts the first timing when the power supply line DSL101 is dropped from the first potential to the lower second potential so that an emission period of the light emitting element 3D can be adjusted.

The pixel 101 shown in FIG. 3B is provided, with a mobility correction function in addition to the above-described threshold voltage correction function. Namely, after the sampling transistor 3A becomes conductive, the signal selector (HSEL) 103 changes the signal line DTL101 from the reference potential to the signal potential at a fourth timing, whereas the main scanner (WSCN) 104 removes the application of the control signal to the scan line WSL101 at a fifth timing after the fourth timing to make the sampling transistor 3A non-conductive. By properly setting the period between the fourth and fifth timings, a correction of the mobility μ of the driver transistor 3B is added to the signal potential when the signal potential is held in the holding capacitor 3C.

The pixel circuit 101 shown in FIG. 3B also has a bootstrap function. Namely, the main scanner (WSCN) 104 removes the application of the control signal to the scan line WSL101 at the fifth timing when the signal potential is held in the holding capacitor 3C to make the sampling transistor 3A non-conductive and electrically disconnect the gate g of the driver transistor 3B from the signal line DTL101. Therefore, the gate potential (Vg) follows a variation in the source potential (Vs) of the driver transistor 3B so that a gate g-source s voltage (Vgs) can be maintained constant.

Figure 4A:
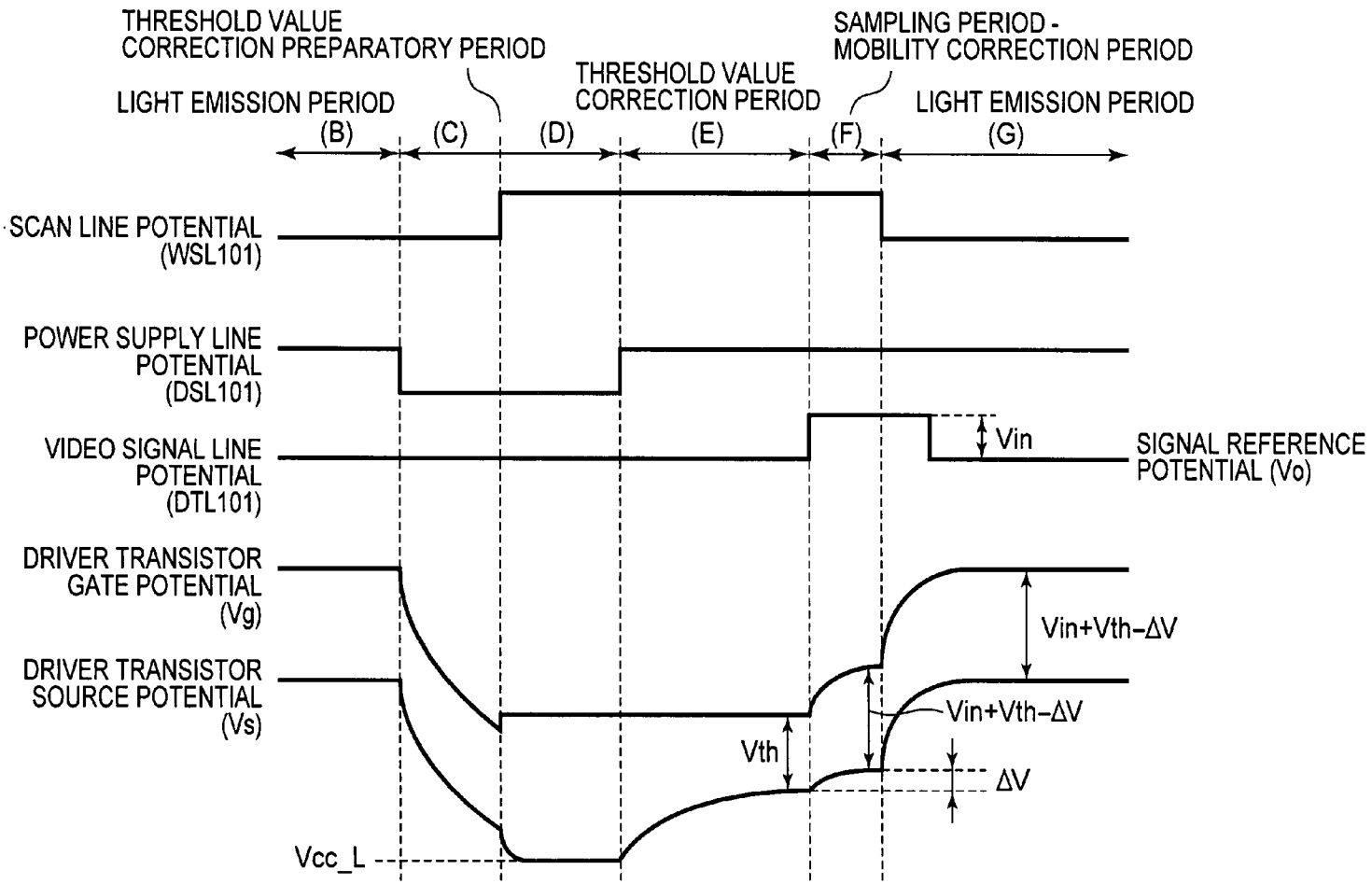
FIG. 4A is a timing chart illustrating the operation of the embodiment shown in FIG. 3B.

FIG. 4A is a timing chart illustrating the operation of the pixel 101 shown in FIG. 3B. A common time axis is used, and the timing chart shows a potential change at the scan line (WSL101), a potential change at the power supply line (DSL101) and a potential change at the signal line (DTL101). Together with these potential changes, a change in the gate potential (Vg) and source potential (Vs) of the driver transistor 3B are also shown.

In this timing chart, periods (B) to (G) are used for the convenience of description in correspondence with the operation transition of the pixel 101. During a light emission period (B), the light emitting element 3D enters an emission state. Thereafter, a new field of line sequential scanning enters at the first timing. First, during the first period (C), the power supply line DSL101 transits to a low potential Vcc_L so that the source potential Vs of the driver transistor 3B lowers to a potential near Vcc_L. If a wiring capacitance of the power supply line DSL101 is large, the first timing is advanced to ensure the time for changing the power supply line DSL101 to the low potential Vcc_L. In this manner, by providing the threshold voltage correction preparatory period (C), the time to transit the power supply line DSL101 to the low potential Vcc_L can be obtained sufficiently while considering a time constant determined by the wiring resistance and capacitance of the power supply line DSL 101. The time duration of the threshold voltage correction preparatory period (C) can be set as desired.

With the next period (D) entered at the second timing, as the scan line WS101 transits from the low level to the high level, the gate potential Vg of the driver transistor 3B takes the reference potential Vo at the video signal line DTL101 so that the source potential Vs is fixed immediately to Vcc_L. This period (D) is included in the threshold voltage correction preparatory period. Preparation of the threshold voltage correction operation is completed by initializing (resetting) the gate potential Vg and source potential Vs of the driver transistor 3B during the threshold voltage correction preparatory period (C and D). Since the light emitting element enters a non-emission state during the threshold voltage correction preparatory period (C and D), a ratio of the emission period to one field can be adjusted by adjusting the first timing when the threshold voltage correction preparatory period starts. Adjusting a ratio (duty) of the emission period to one field means adjusting the screen luminance. Namely, by controlling the first timing when the power supply line DTL is lowered to the low potential from the high potential, the screen luminance can be adjusted. If this adjustment is performed for each of three primary colors RGB, a screen white balance can be adjusted.

After the threshold voltage correction preparatory period (D) is completed, a threshold voltage correction period (E) enters at the third timing to actually execute the threshold voltage correction operation and hold the voltage corresponding to the threshold voltage Vth between the gate g and source s of the driver transistor 3B. The voltage corresponding to Vth is actually written in the holding capacitor 3C connected between the gate g and source s of the driver transistor 3B. Thereafter, a sampling period—mobility correction period (F) enters at the fourth timing. The signal potential Vin of the video signal is written in the holding capacitor 3C, being added to Vth, and a mobility correction voltage ΔV is subtracted from the voltage held in the holding capacitor 3C.

Thereafter, with the light emission period (G) entered, the light emitting element emits light at a luminance corresponding to the signal voltage Vin. In this case, since the signal voltage Vin is adjusted by the voltage corresponding to the threshold voltage Vth and the mobility correction voltage ΔV, the emission luminance of the light emitting element 3D is not influenced by a variation in the threshold voltage Vth and mobility μ of the driver transistor 3B. A bootstrap operation is executed at the start (fifth timing) of the light emission period (G), and the gate potential Vg and source potential Vs of the driver transistor 3B rise while the gate-source voltage Vgs=Vin+Vth−ΔV of the driver transistor 3B is maintained constant.

Figure 4B:
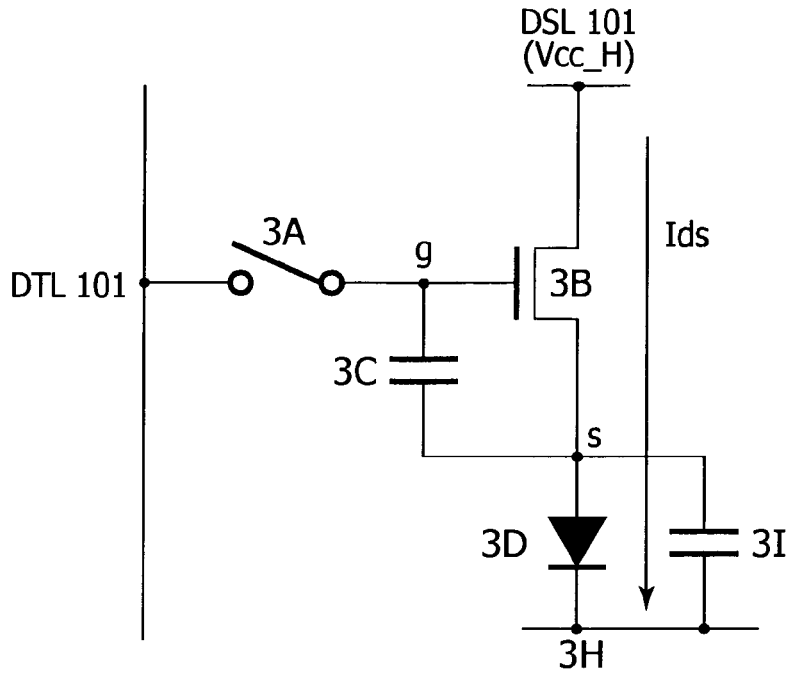
FIG. 4B is a circuit diagram illustrating the operation of the embodiment.

With reference to FIGS. 4B to 4G, the operation of the pixel 101 shown in FIG. 3B will be described in detail. The representations of FIGS. 4B to 4G correspond to the periods (B) to (G) of the timing chart shown in FIG. 4A. In FIGS. 4B to 4G, the capacitive component of the light emitting element 3D is drawn as a capacitor element 3I for the convenience of description and easy understanding. First, as shown in FIG. 4B, during the light emission period (B), a power supply line DSL101 is at a high potential Vcc_H (first potential) and a driver transistor 3B supplies a drive current Ids to a light emitting element 3D. As shown in FIG. 4B, the drive current Ids flows from the power supply line DSL101 at the high potential Vcc_H to the light emitting element 3D via the driver transistor 3B and thereafter to a common ground wiring 3H.

Figure 4C:
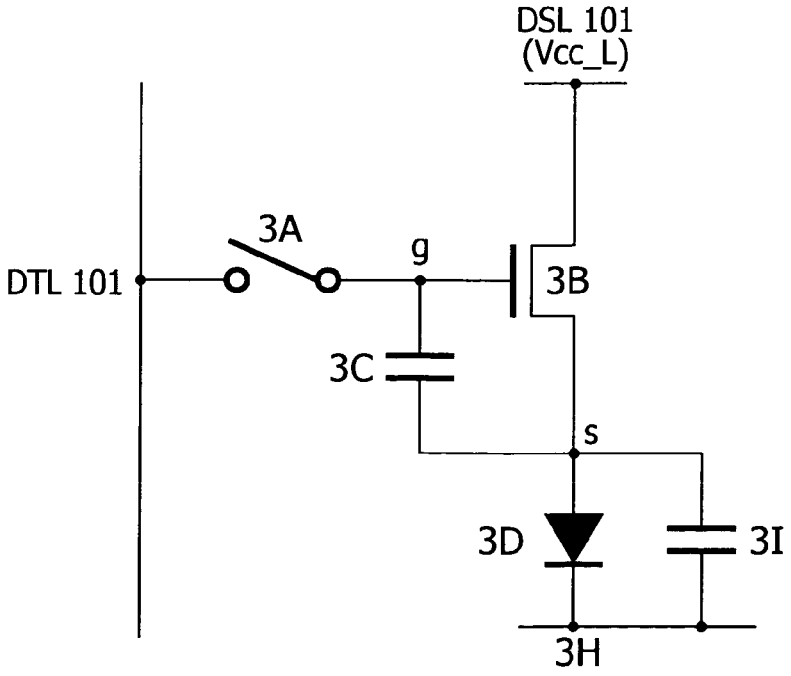
FIG. 4C is a circuit diagram illustrating the operation of the embodiment.

Next, with the period (C) entered, the power supply line DSL101 is changed from the high potential Vcc_H to the low potential Vcc-L, as shown in FIG. 4C. The power supply line DSL101 is therefore discharged to Vcc_L, and the source potential Vs of the driver transistor 3B transits to a potential near Vcc_L. If a wiring capacitance of the power supply line DSL101 is large, it is preferable that the power supply line DSL101 is changed from the high potential Vcc_H to the low potential Vcc_L at a relatively early timing. This period (C) is retained sufficiently so as not to be influenced by a wiring capacitance and other pixel parasitic capacitance.

Figure 4D:
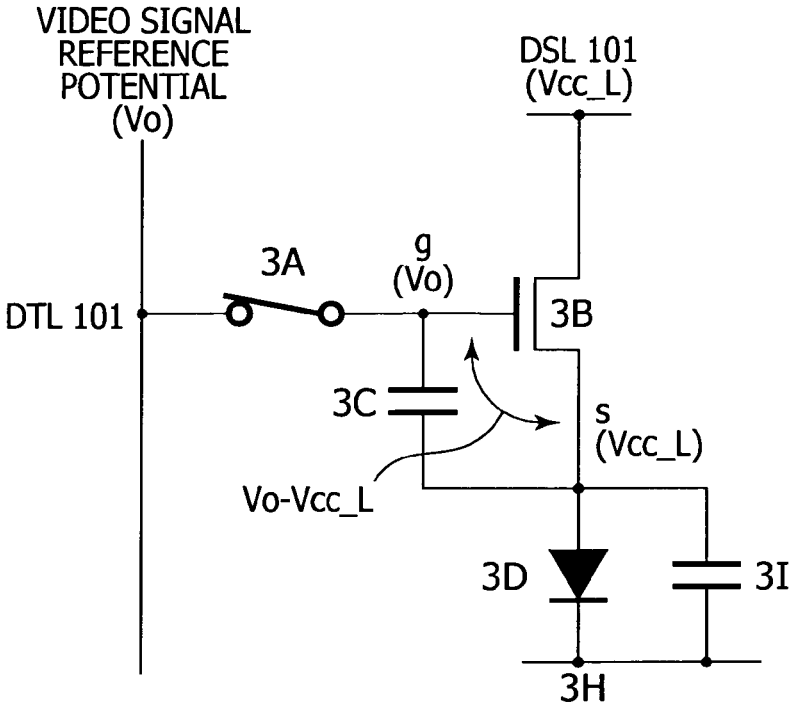
FIG. 4D is a circuit diagram illustrating the operation of the embodiment.

Next, with the period (D) entered, the scan line WSL101 is changed from the low level to the high level to make the sampling transistor 3A conductive, as shown in FIG. 4D. At this time, the video signal line DTL101 takes the reference potential Vo. Therefore, the gate potential Vg of the driver transistor 3B takes the reference potential Vo of the video signal line DTL101 via the conductive sampling transistor 3A. At the same time, the source potential Vs of the driver transistor 3B is fixed immediately to the low potential Vcc_L. With these operations, the source potential Vs of the driver transistor 3B is initialized (reset) to the potential Vcc_L sufficiently lower than the reference potential Vo at the video signal line DTL. More specifically, the low potential Vcc_L (second potential) is set to the power supply line DSL101 so that a gate-source voltage Vgs (a difference between the gate potential Vg and source potential Vs) of the driver transistor 3B becomes higher than the threshold voltage Vth of the driver transistor 3B.

Figure 4E:
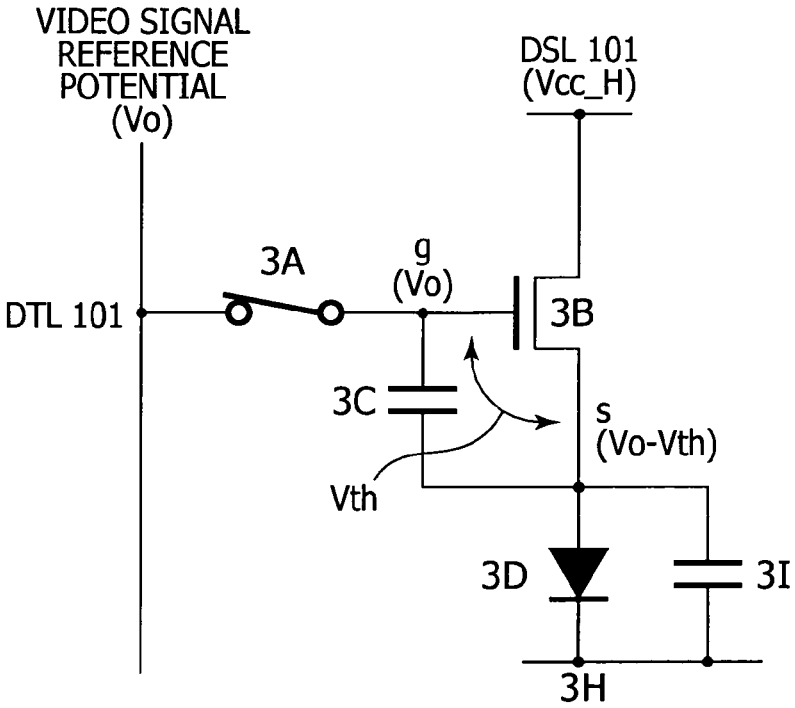
FIG. 4E is a circuit diagram illustrating the operation of the embodiment.

Next, with the threshold voltage correction period (E) entered, the potential of the power supply line DSL101 transits from the low potential Vcc_L to the high potential Vcc_H, and the source potential Vs of the driver transistor 3B starts rising, as shown in FIG. 4E. When the gate-source voltage Vgs of the driver transistor 3B takes the threshold voltage Vth, the current is cut off. In this way, a voltage corresponding to the threshold voltage Vth of the driver transistor 3B is written in the holding capacitor 3C. This operation is the threshold voltage correction operation. A potential at the common ground wiring 3H is set so that the light emitting element 3D is cut off, and current flows mainly on the side of the holding capacitor 3C and does not flow on the side of the light emitting element 3D.

Figure 4F:
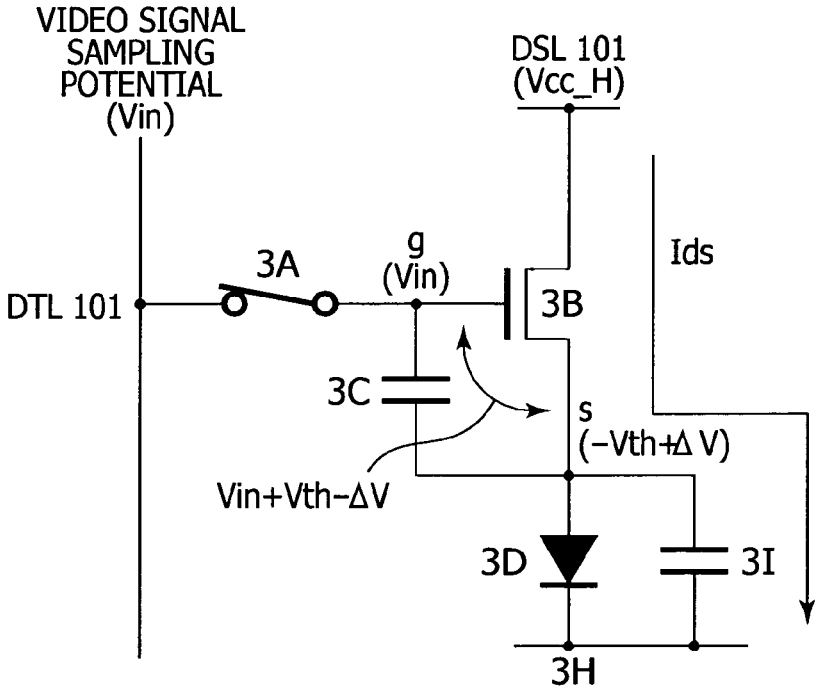
FIG. 4F is a circuit diagram illustrating the operation of the embodiment.

Then, with the sampling period/mobility correction period (F) entered, the potential at the video signal line DTL101 transits from the reference potential Vo to the signal potential Vin at the first timing so that the gate potential Vg of the driver transistor 3B takes Vin, as shown in FIG. 4F. At this time, since the light emitting element 3D is initially in the cutoff state (high impedance state), a drain current Ids of the driver transistor 3B flows into the parasitic capacitor 3I. The parasitic capacitor 3I of the light emitting element starts charging. Therefore, the source potential Vs of the driver transistor 3B starts rising, and the gate-source voltage Vgs of the driver transistor 3B takes Vin+Vth−ΔV at the second timing. In this manner, sampling the signal potential Vin and adjusting the correction amount ΔV are performed. The higher Vin is, the larger the current Ids becomes and the larger the absolute value of ΔV becomes. Therefore, a mobility correction in accordance with an emission luminance level can be performed. If Vin is constant, the larger the mobility μ of the driver transistor 3B is, the larger the absolute value of ΔV is. In other words, since the negative feedback amount Δ becomes larger as the mobility μ becomes higher, a variation in mobilities of pixels can be removed.

Figure 4G:
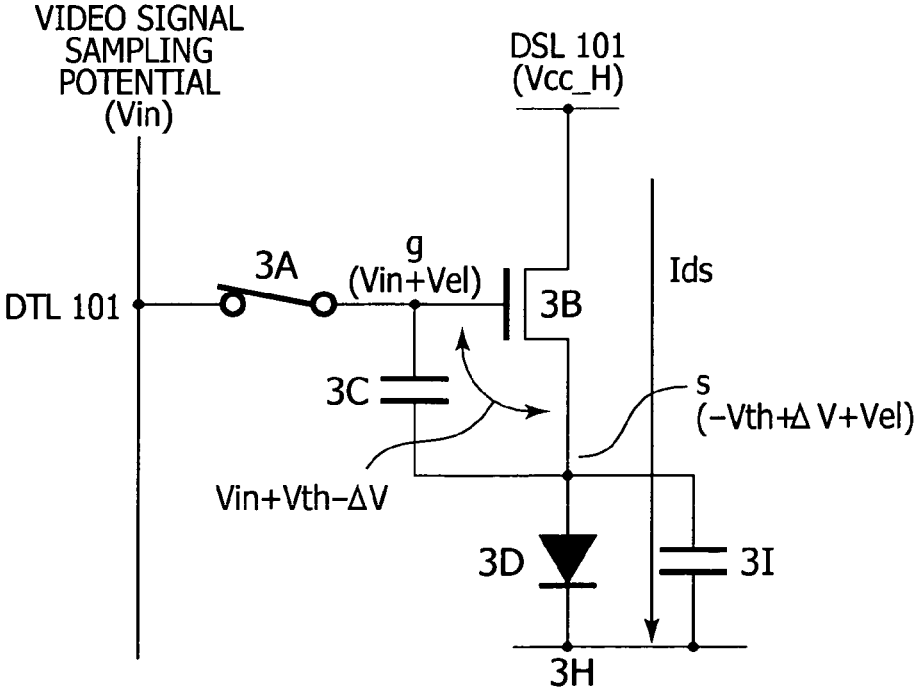
FIG. 4G is a circuit diagram illustrating the operation of the embodiment.

Lastly, with the light emission period (G) entered, the scan line WSL101 transits to the low potential side and the sampling transistor 3A turns off, as shown in FIG. 4G. The gate g of the driver transistor 3B is therefore disconnected from the signal line DTL101. At the same time, a drain current Ids starts flowing in the light emitting element 3D. The anode potential of the light emitting element 3D rises by Vel in accordance with the drive current Ids. A rise of the anode potential of the light emitting element 3D is a rise of the source potential Vs of the driver transistor. As the source potential Vs of the driver transistor 3B rises, the gate potential Vg of the drive transistor 3B rises by the bootstrap operation of the holding capacitor 3C. A rise amount Vel of the gate potential Vg is equal to a rise amount Vel of the source potential Vs. Therefore, the gate-source voltage Vgs of the driver transistor 3B during the light emission period is maintained constant at Vin+Vth−ΔV.

Figure 5A:
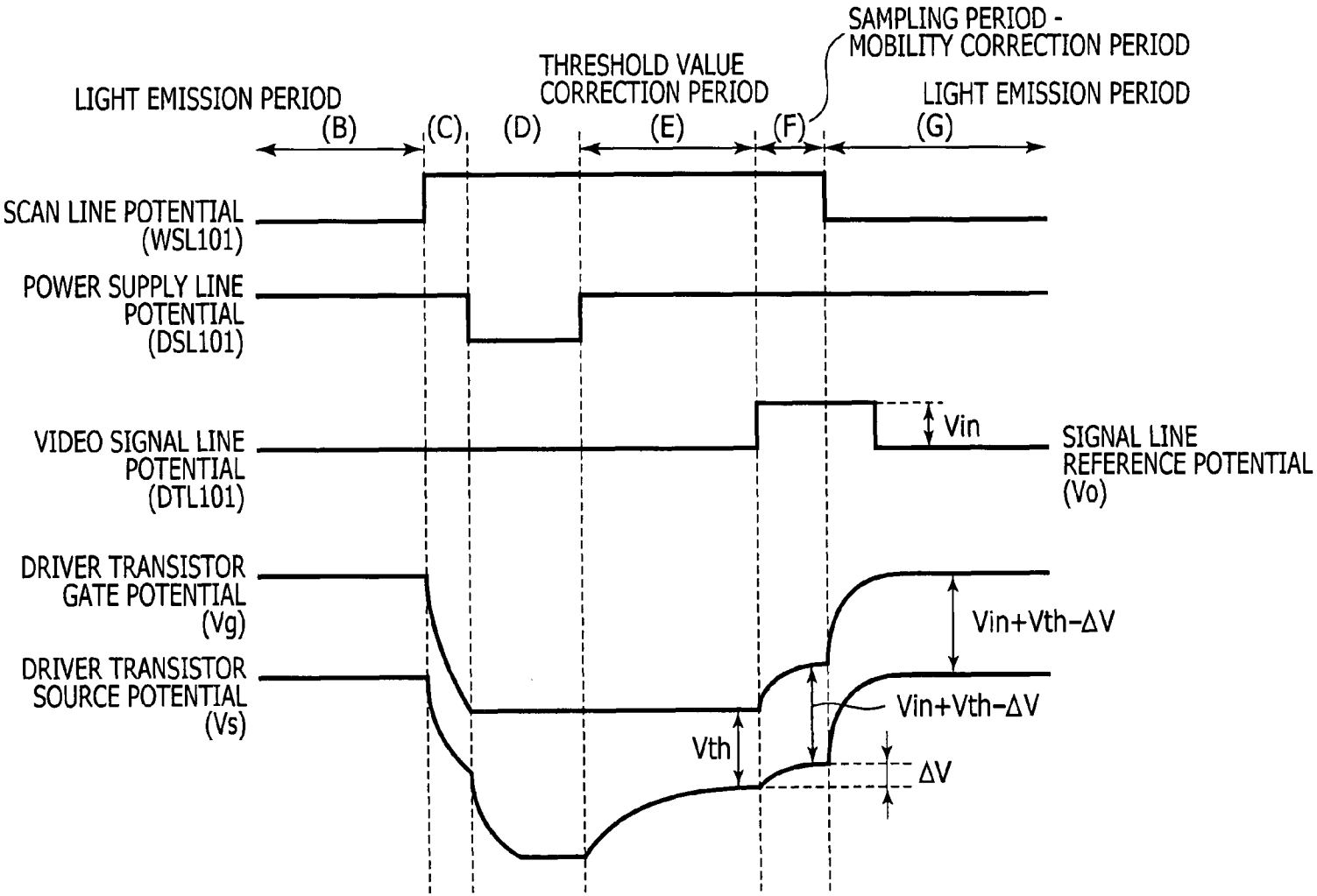
FIG. 5A is a timing chart illustrating a reference example of a driving method for a display device.

FIG. 5A is a timing chart illustrating a reference example of the driving method for the display device shown in FIG. 3B. In order to make it easy to understand, corresponding portions to the timing chart illustrating the driving method of the present invention shown in FIG. 4A are represented by corresponding reference numerals. A different point of this reference example resides in that during the threshold voltage correction preparatory period (C and D), the scan line is first changed from the low level to the high level, and thereafter the power supply line is changed from the high potential to the low potential. As described earlier, the driving method of an embodiment of the present invention first changes the power supply line from the high potential to the low potential, and thereafter the scan line is changed from the low level to the high level. In the reference example, the threshold voltage correction period (E), the sampling period—mobility correction period (F) and the light emission period (G) after the threshold-voltage correction period (C and D) are the same as those of the driving method for the display device of an embodiment of the present invention.

Figure 5B:
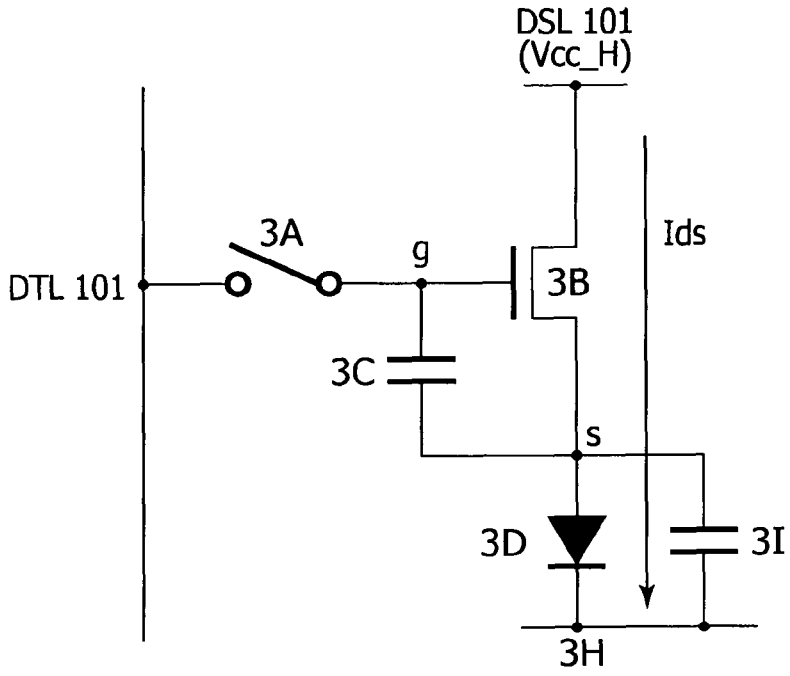
FIG. 5B is a circuit diagram illustrating the operation of the reference example.
Figure 5C:
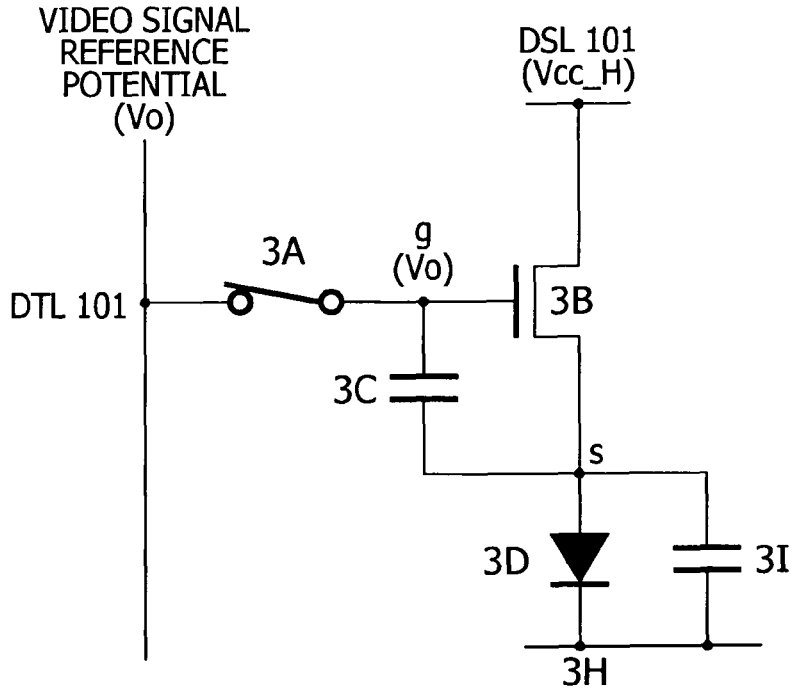
FIG. 5C is a circuit diagram illustrating the operation of the reference example.
Figure 5D:
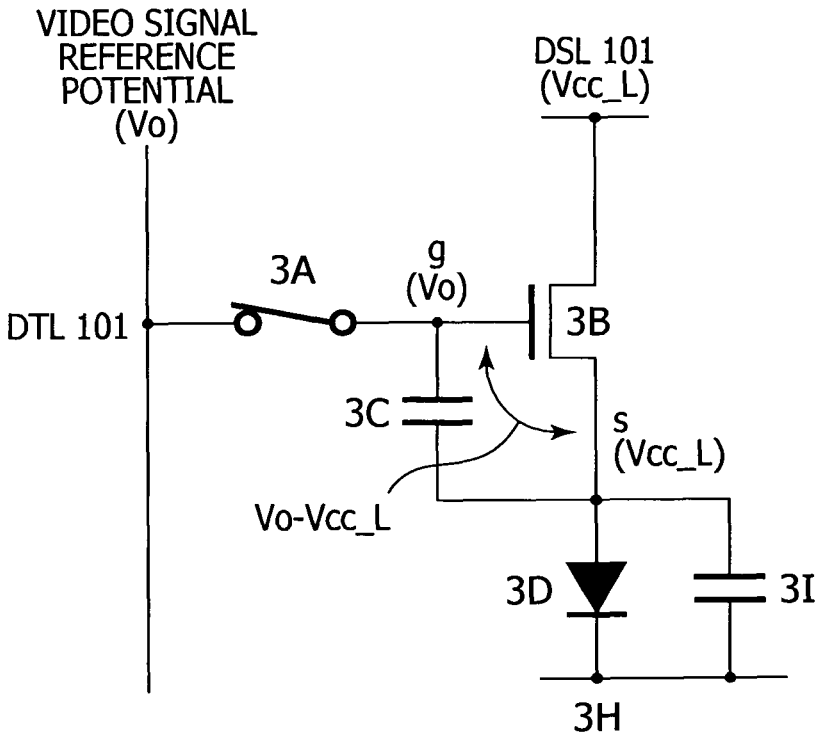
FIG. 5D is a circuit diagram illustrating the operation of the reference example.

With reference to FIGS. 5B, 5C and 5D, the driving method for the display device of the reference example shown in FIG. 5A will be described further. First, as shown in FIG. 5B, during the light emission period (B), the power supply line DSL101 is at the high potential Vcc_H (first potential), and the driver transistor 3B supplies a drive current Ids to the light emitting element 3D. As shown in the Figures, the drive current Ids flows from the power supply line DSL101 at the high potential Vcc_H to the light emitting element 3D via the driver transistor 3B and thereafter to a common ground wiring 3H.

Then, with the period (C) entered, the scan line WSL101 is changed from the low level to the high level so that the sampling transistor 3A turns on, as shown in FIG. 5C. Thus, the gate potential Vg of the driver transistor 3B takes the reference potential Vo at the video signal line DTL 101.

With the period (D) entered next, the power supply line DSL101 transits from the high potential Vcc_H to the low potential Vcc-L sufficiently lower than the reference potential Vo at the video signal line DTL101, as shown in FIG. 5D. Therefore, the source potential Vs of the driver transistor 3B also takes the potential Vcc_L sufficiently lower than the reference voltage Vo at the video signal line DTL101. More specifically, the low potential Vcc_L is set to the power supply line DSL101 so that the gate-source voltage Vgs (a difference between the gate potential Vg and source potential Vs) takes the threshold voltage Vth or higher of the driver transistor 3B. With these operations, the gate and source of the driver transistor 3B are reset to predetermined potentials to complete the preparatory operation of threshold voltage correction.

Figure 6:
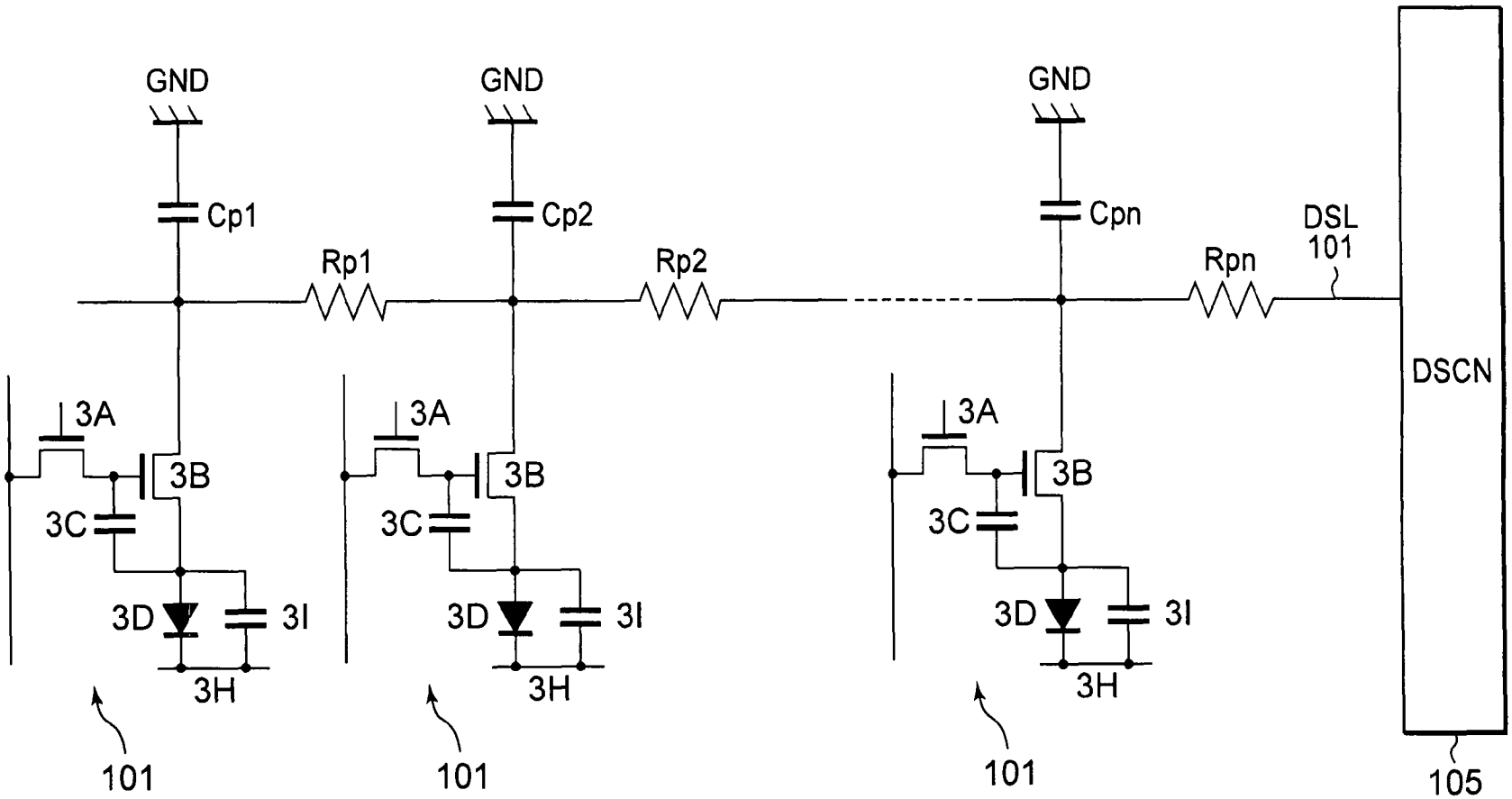
FIG. 6 is a schematic circuit diagram showing wiring capacitances and resistances of a display device.

FIG. 6 is a schematic diagram showing wiring resistors Rp1 to Rpn and wiring capacitors Cp1 to Cpn of the power supply line DSL101 that are to be selectively driven by the drive scanner (DSCN) 105. A time constant T of the power supply line DSL101 shown in FIG. 6 is represented approximately by the following equation.

$$\tau=(Rp1+Rp2+,\ldots,Rpn)\times(Cp1+Cp2,\ldots,Cpn)$$

If the pixel array portion of the display device has a higher precision large screen, the time constant τ becomes longer.

In the operation of the reference example shown in FIG. 5D, a charge/discharge time of approximately 5×τ is required in order to transit the power supply line DSL101 from the high potential Vcc_H to the potential Vcc_L sufficiently lower than the reference potential Vo of the video signal line DTL101.

Figure 7:
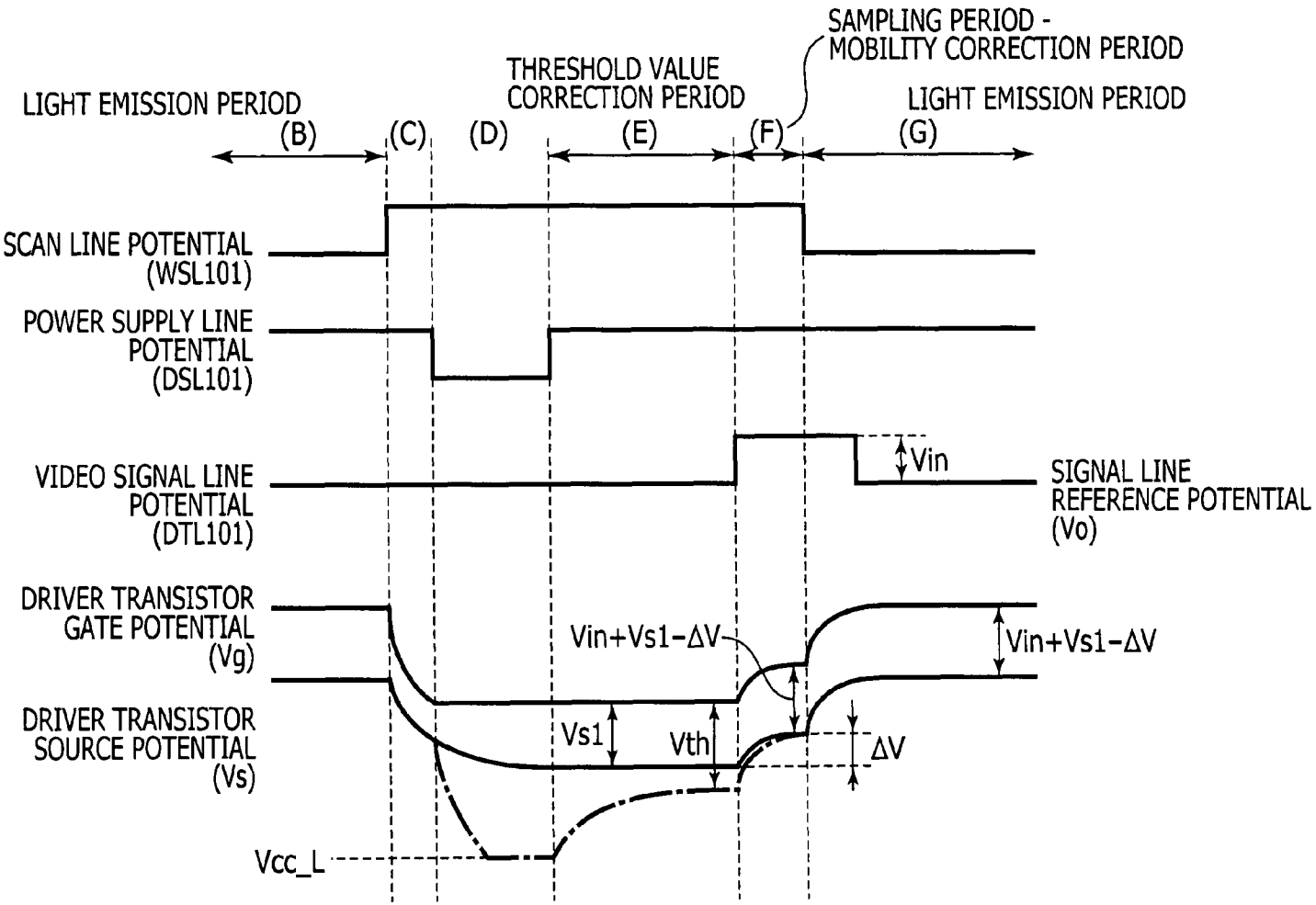
FIG. 7 is a timing chart illustrating other reference embodiment of a driving method for a display device.

FIG. 7 is a timing chart illustrating the operation of the reference example.

This timing chart is basically the same as that of the reference example shown in FIG. 5A. This timing chart illustrates a case in which the preparatory period (D) does not attain a time of 5×τ T necessary for the power supply line DSL101 to transit to the potential Vcc_L. As shown, in the reference example, since the preparatory period (D) has an insufficient transition time to the potential Vcc_L, the source potential Vs of the driver transistor 3B does not reach Vcc_L, so that the gate-source voltage Vgs of the driver transistor 3B takes only Vs1 and does not attain the value exceeding the threshold voltage Vth. Therefore, in the next threshold voltage correction period (E), a normal threshold voltage correction operation may be impossible. An embodiment of the present invention solves this issue of the reference example. By first changing the power supply line from the high potential to the low potential, the source potential Vs of the driver transistor is reliably reset to Vcc_L, so that the threshold voltage correction operation can be executed reliably.

Figure 8:
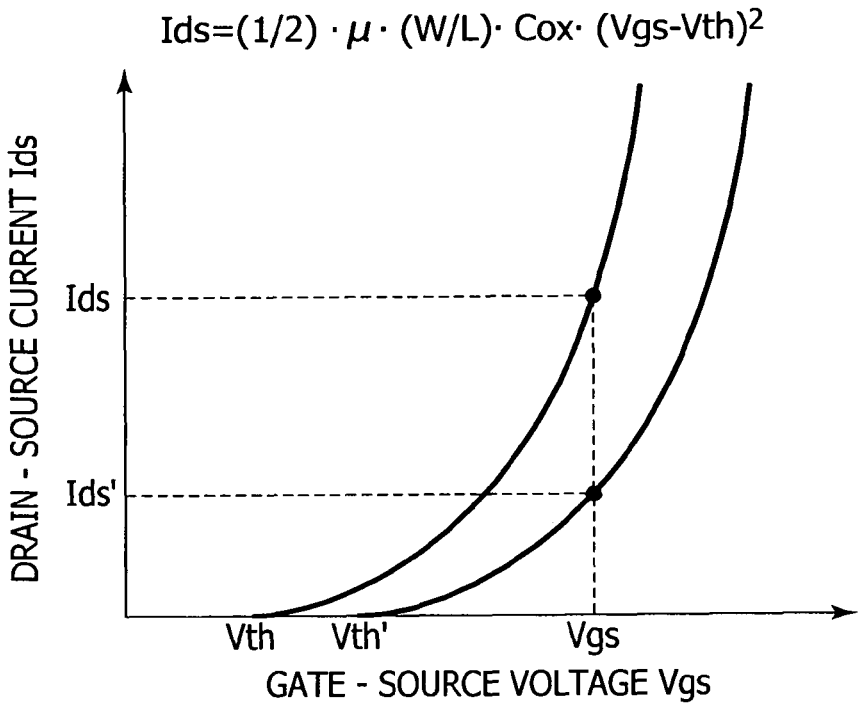
FIG. 8 is a graph showing current-voltage characteristics of a driver transistor.

A further detailed description will be made on the threshold-voltage correction function, the mobility correction function and the bootstrap function that are equipped in the display device of an embodiment of the present invention. FIG. 8 is a graph showing the current/voltage characteristics of a driver transistor. A drain-source current Ids, particularly when the driver transistor operates in a saturated region, is represented by $Ids=(1/2)\cdot\mu\cdot(W/L)\cdot Cox\cdot(Vgs-Vth)^2$, where μ represents a mobility, W represents a gate width, L represents a gate length, and Cox represents a gate oxide film capacitance per unit area. As apparent from this transistor characteristic equation, as the threshold voltage Vth changes, the drain-source current Ids changes even if Vgs is constant. As described earlier, in the pixel of the present invention, the gate source voltage Vgs is represented by Vin+Vth−ΔV. This is substituted into the transistor characteristic equation. The drain-source current Ids is therefore represented by $Ids=(1/2)\cdot\mu\cdot(W/L)\cdot Cox\cdot(Vin-\Delta V)^2$ and is independent from the threshold voltage Vth. Therefore, even if the threshold voltage varies due to manufacturing processes, the drain-source current Ids will not change and an emission luminance of the organic EL device will not change.

If any countermeasure is not taken, as shown in FIG. 8, a drive current is Ids at Vgs when the threshold voltage is Vth, whereas a drive current is Ids' at Vgs when the threshold voltage is Vth', which current is different from Ids.

Figure 9A:
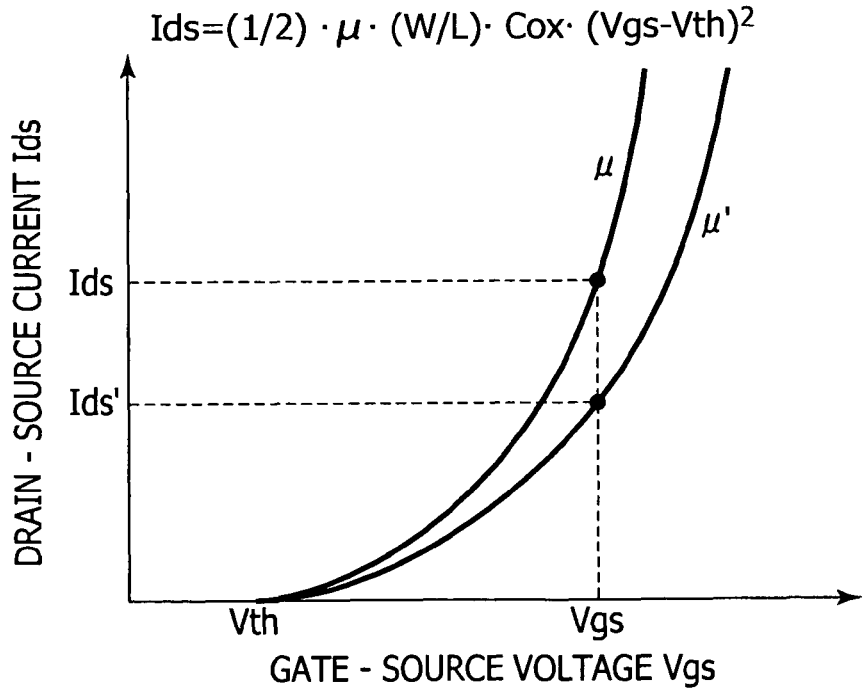
FIG. 9A is a graph showing the current-voltage characteristics of a driver transistor.

FIG. 9A is a graph showing the current-voltage characteristics of driver transistors. Characteristics curves are shown for two driver transistors having different μ and μ'. As seen from the graph, drain-source currents of the driver transistors having different μ and μ' are Ids and Ids' even at the same Vgs.

Figure 9B:
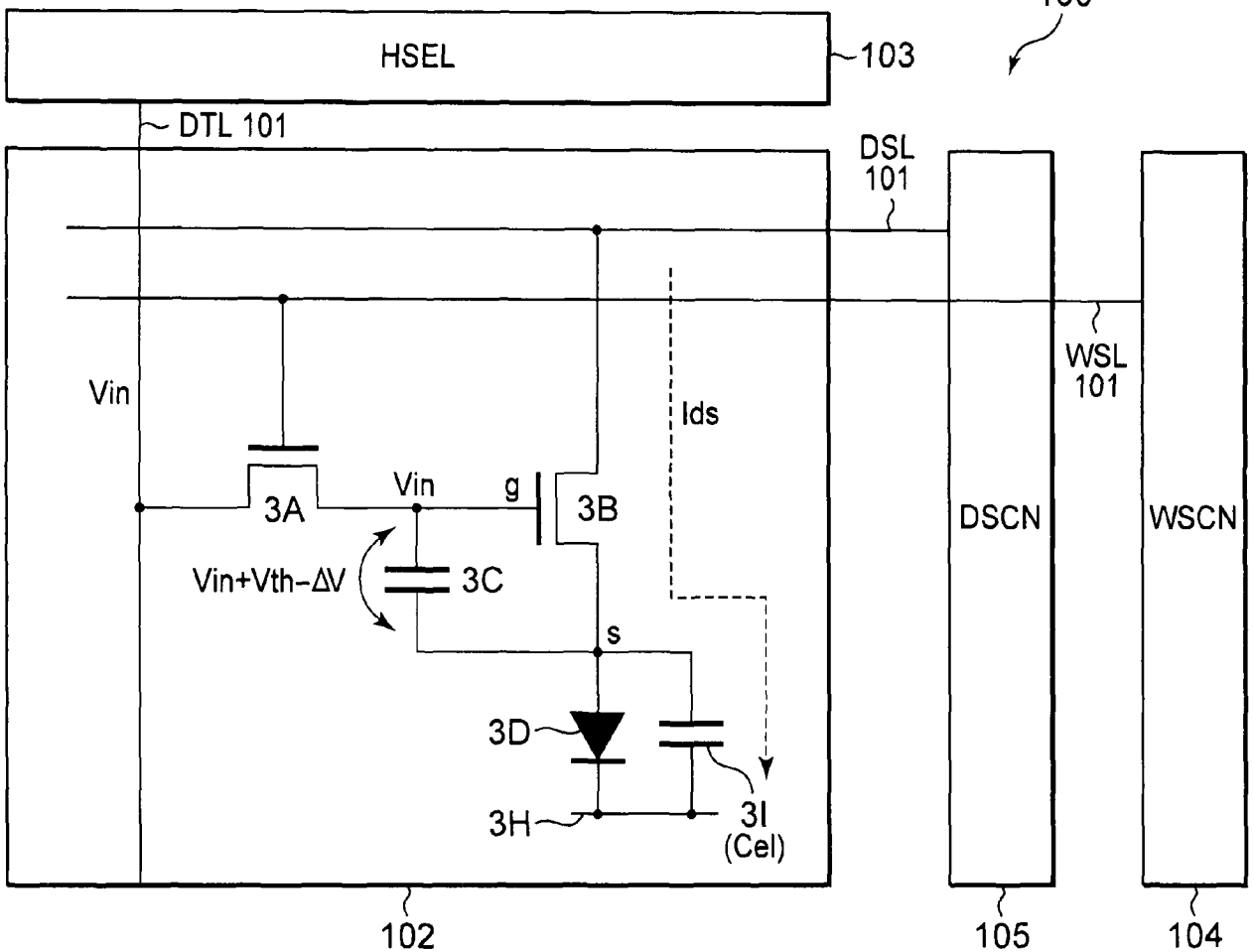
FIG. 9B is a circuit diagram illustrating the operation of a display device of an embodiment of the present invention.

FIG. 9B illustrates the operation of a pixel when a video signal potential is sampled and when a mobility is corrected. In order to make it easy to understand, a parasitic capacitor 3I of a light emitting element 3D is shown. When a video signal potential is sampled, the gate potential Vg of the driver transistor 3B is a video signal potential Vin because the sampling transistor 3A is in the on-state, and a gate-source voltage Vgs of the driver transistor 3B is Vin+Vth. In this case, since the driver transistor 3B is in the on-state and the light emitting element 3D is in the cut-off state, a drain-source current Ids flows into the light emitting element capacitor 3I. As the drain-source current Ids flows into the light emitting element capacitor 3I, the light emitting element capacitor 3I starts charging, and the anode potential of the light emitting element 3D (i.e., the source potential Vs of the driver transistor 3B) starts rising. As the source potential Vs of the driver transistor 3B rises by ΔV, the gate-source voltage Vgs of the driver transistor 3B lowers by ΔV. This corresponds to the mobility correction operation by negative feedback. A reduction amount ΔV of the gate-source voltage Vgs is determined by ΔV=Ids·Cel/t, and ΔV is a parameter for mobility correction. In the equation, Cel represents a capacitance value of the light emitting element capacitor 3I, and t represents a mobility correction period.

Figure 9C:
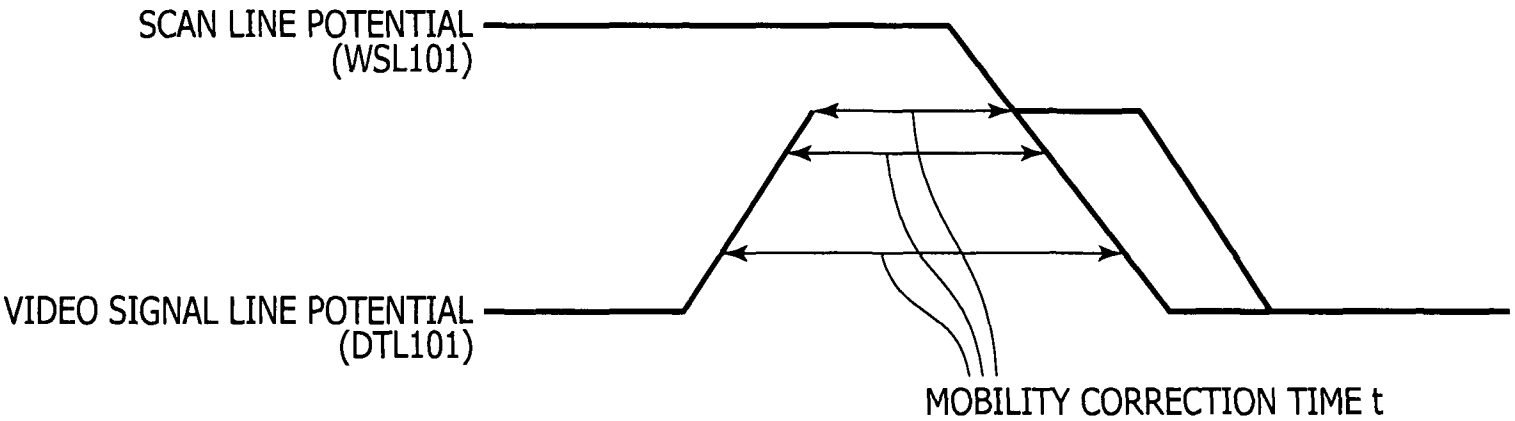
FIG. 9C shows waveforms illustrating the operation of the display device.

FIG. 9C is a schematic diagram illustrating operation timings of the pixel circuit when the mobility correction period is determined. In the embodiment shown, a rise of a video line signal potential is slanted so that the mobility correction period t automatically flows the video signal line potential to optimize the mobility correction period. As shown, the mobility correction period t is determined by a phase difference between the scan line WS101 and video signal line DTL101, and it is also determined by a potential at the video signal line DTL101. The mobility correction parameter ΔV is ΔV=Ids·Cel/t. As seen from this equation, the larger the drain-source current Ids of the driver transistor 3B is, the larger the mobility correction parameter ΔV is. Conversely, the smaller the drain-source current Ids of the driver transistor 3B is, the smaller the mobility correction parameter ΔV is. The mobility correction parameter ΔV is therefore determined by the drain-source current Ids. It is not always required that the mobility correction period t be constant, but it is preferable in some cases to adjust the mobility correction period by Ids. For example, if Ids is large, the mobility correction period t is preferably set shorter, whereas if Ids is small, the mobility correction period t is preferably set longer. In the embodiment shown in FIG. 9C, at least a rise of the video signal line potential is slanted so that the correction period t is automatically set short when the potential of the video signal line DTL101 is high (when Ids is large) and the correction period t is automatically set long when the potential of the video signal line DTL101 is low (when Ids is small).

Figure 9D:
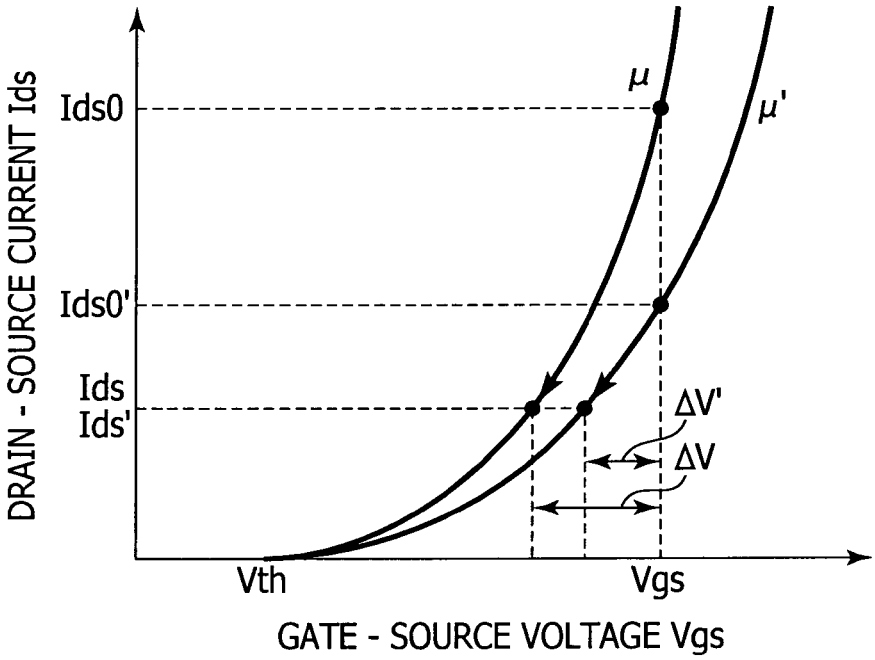
FIG. 9D is a current-voltage characteristic graph illustrating the operation of the display device.

FIG. 9D is a graph illustrating operation points of driver transistors 3B when the mobility is corrected. The above-described mobility correction is conducted relative to a variation in μ and μ' due to manufacture processes to determine optimum correction parameters ΔV and ΔV' and drain-source currents Ids and Ids' of the driver transistors 3B. If the mobility correction is not conducted, drain-source currents are different, i.e., Ids0 and Ids0', at the same gate-source voltage Vgs because of different mobilities μ and μ'. In order to avoid this, proper corrections ΔV and ΔV' are given to the mobilities μ and μ' so that the drain-source currents are Ids and Ids' at the same level. As seen from the graph of FIG. 9D, negative feedback is given in such a manner that the correction amount ΔV becomes large when the mobility μ is large, and the correction amount ΔV' becomes small when the mobility μ' is small.

Figure 10A:
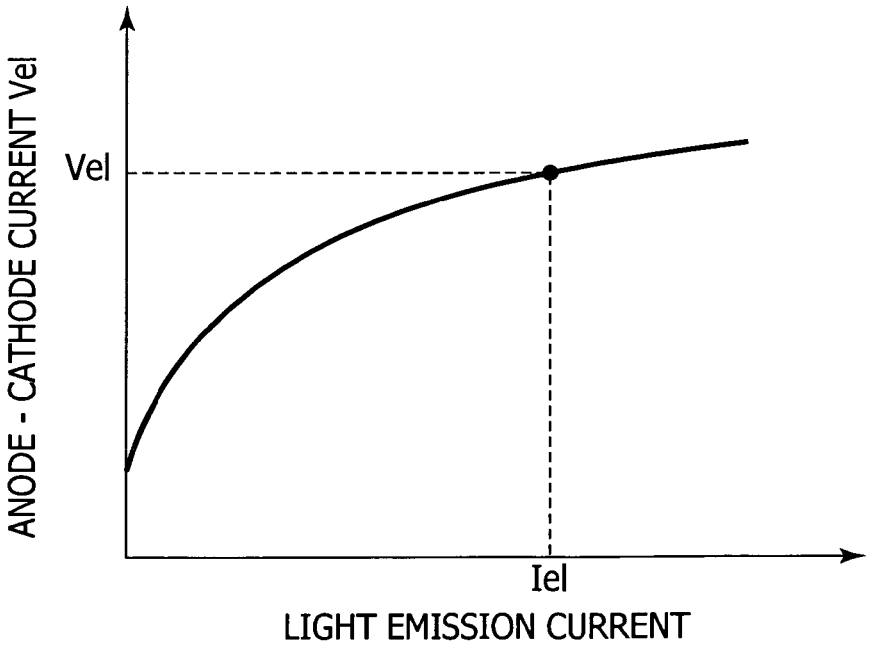
FIG. 10A is a graph showing current-voltage characteristics of a light emitting element.

FIG. 10A is a graph showing current-voltage characteristics of a light emitting element 3D made of an organic EL device. As current Iel flows into the light emitting element 3D, an anode-cathode voltage Vel is determined uniquely. As shown in FIG. 4G, the scan line WSL101 transits to the low potential side during a light emission period, and when the sampling transistor 3A enters the off-state, the anode of the light emitting element 3D rises by the anode-cathode voltage Vel determined by the drain-source current Ids of the driver transistor 3B.

Figure 10B:
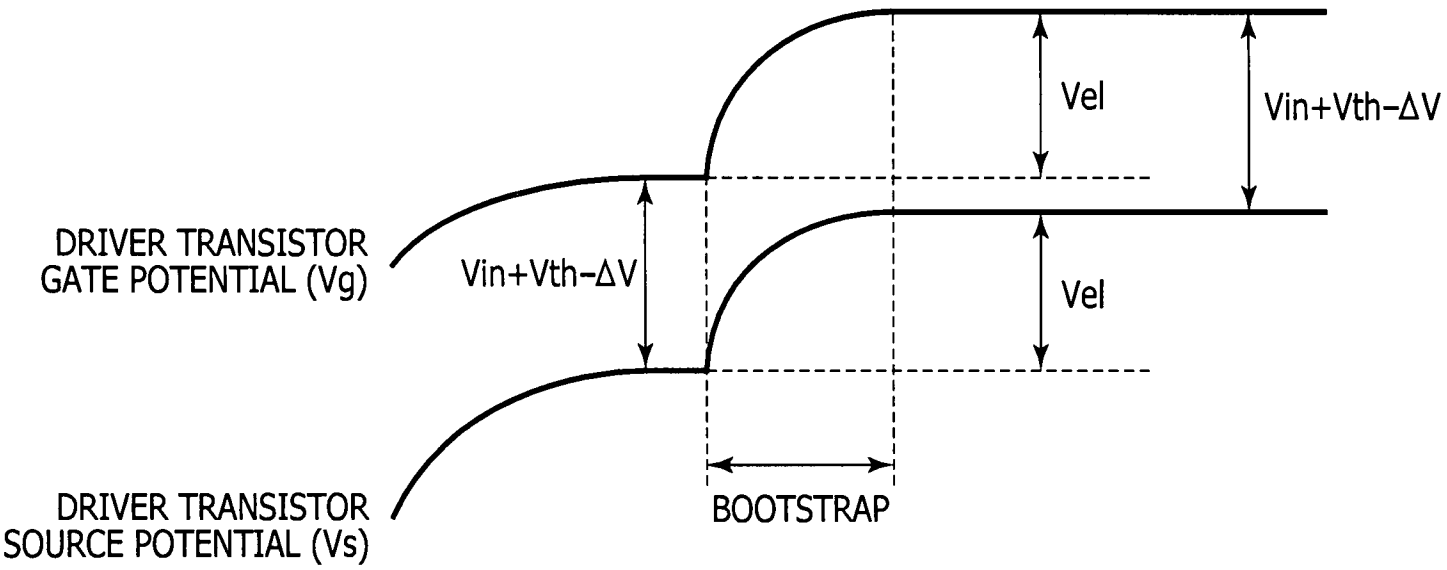
FIG. 10B shows waveforms illustrating the operation of a bootstrap operation of a driver transistor.

FIG. 10B is a graph showing a potential change in the gate potential Vg and source potential Vs of the driver transistor while the anode potential of the light emitting element 3D rises. When the anode potential of the light emitting element 3D rises by Vel, the source of the driver transistor 3B also rises by Vel, and the gate of the driver transistor 3B rises by Vel by the bootstrap operation of the holding capacitor 3C. Therefore, the gate-source voltage Vgs=Vin+Vth−ΔV of the drive transistor 3B held before the bootstrap is maintained even after the bootstrap. Even when the anode potential varies due to secular deterioration of the light emitting element 3D, the gate-source voltage of the driver transistor 3B is always maintained constant at Vin+Vth−ΔV.

Figure 10C:
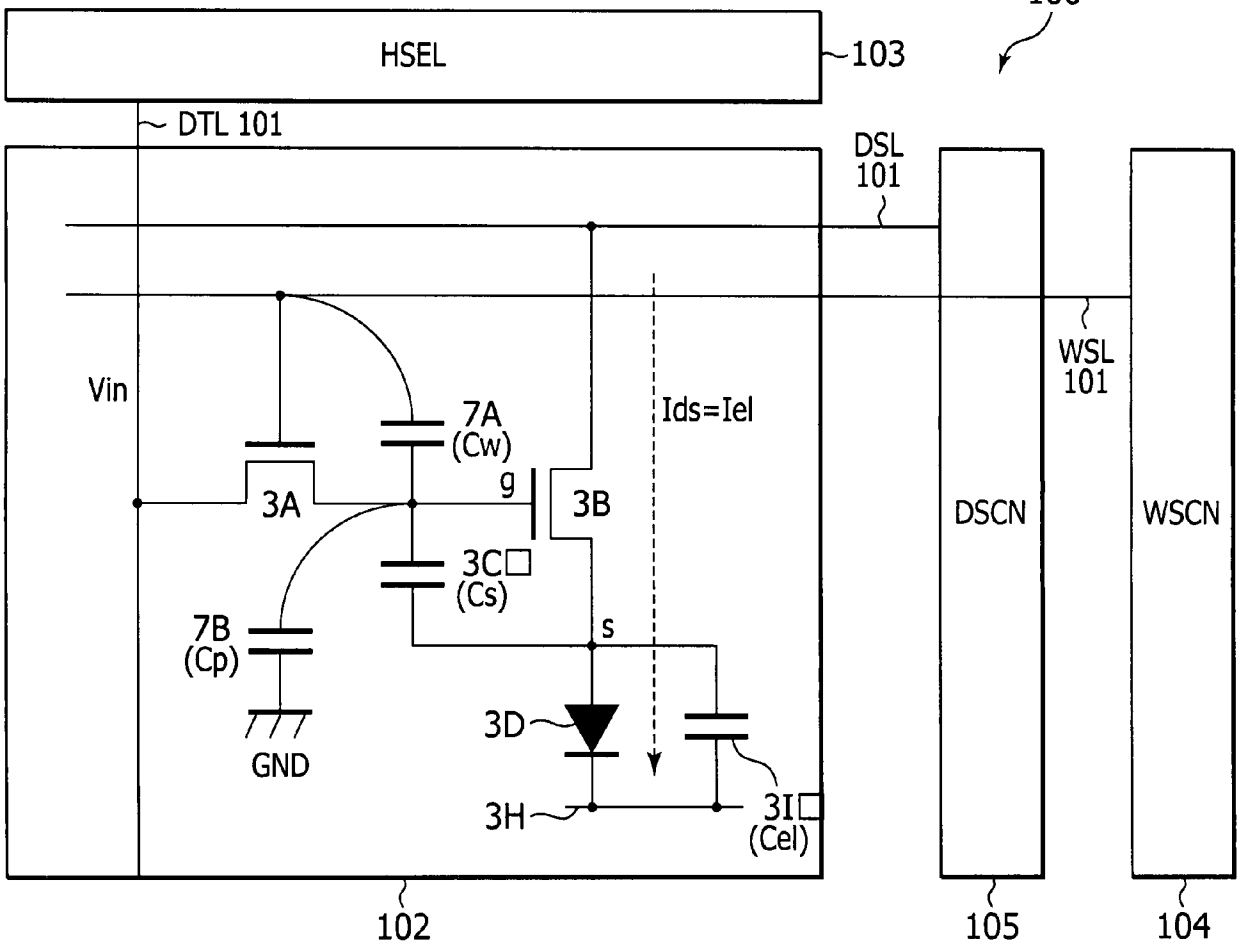
FIG. 10C is a circuit diagram illustrating the operation of a display device of an embodiment of the present invention.

FIG. 10C is a circuit diagram adding parasitic capacitors 7A and 7B to the pixel structure of the present invention described with reference to FIG. 3B. The parasitic capacitors 7A and 7B are parasitic capacitors of the gate g of the driver transistor 3B. The above-described bootstrap ability is represented by Cs/(Cs+Cw+Cp) where Cs is a capacitance value of the holding capacitor, and Cw and Cp are capacitance values of the parasitic capacitors 7A and 7B, respectively. If this value is nearer to "1", the bootstrap ability is high. Namely, this indicates a high correction ability relative to secular deterioration of the light emitting element 3D. According to an embodiment of the present invention, the number of components to be connected to the gate g of the driver transistor 3B is minimized so that Cp can almost be neglected. Therefore, the bootstrap ability is represented by Cs/(Cs+Cw), which is unlimitedly near "1", indicating a high correction ability for secular deterioration of the light emitting element 3D.

Figure 11:
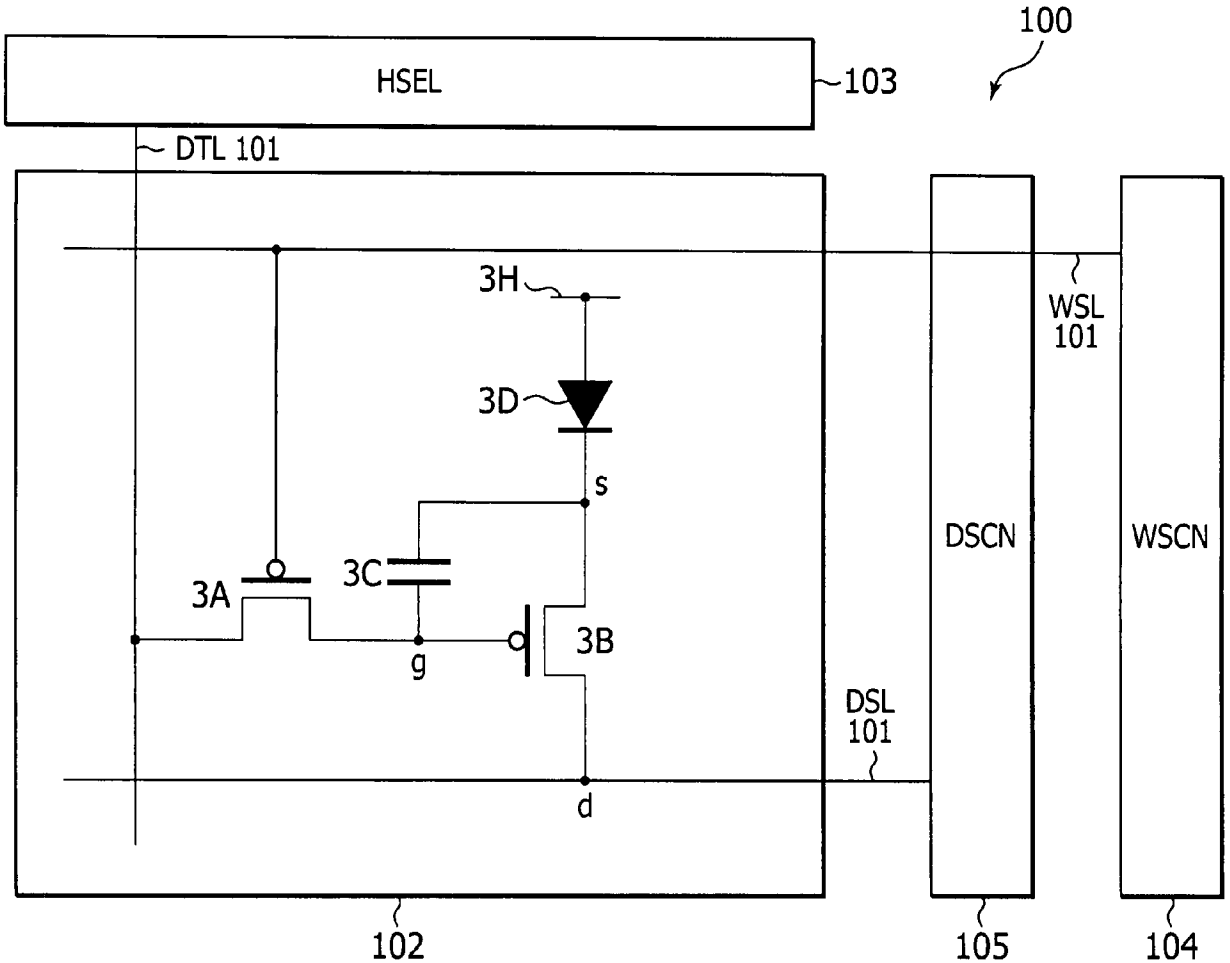
FIG. 11 is a circuit diagram of a display device according to another embodiment of the present invention.

FIG. 11 is a schematic circuit diagram showing a display device according to another embodiment of the present invention. In order to make it easy to understand, constituent elements corresponding to those of the embodiment shown in FIG. 3B are represented by corresponding reference numerals in FIG. 11. A different point resides in that the embodiment shown in FIG. 11 constitutes a pixel circuit by using p-channel transistors, whereas the embodiment shown in FIG. 3B constitutes a pixel circuit by using n-channel transistors. Quite similar to the pixel circuit shown in FIG. 3B, the pixel circuit shown in FIG. 11 also can execute the threshold voltage correction operation, the mobility correction operation and the bootstrap operation.

Figure 12:
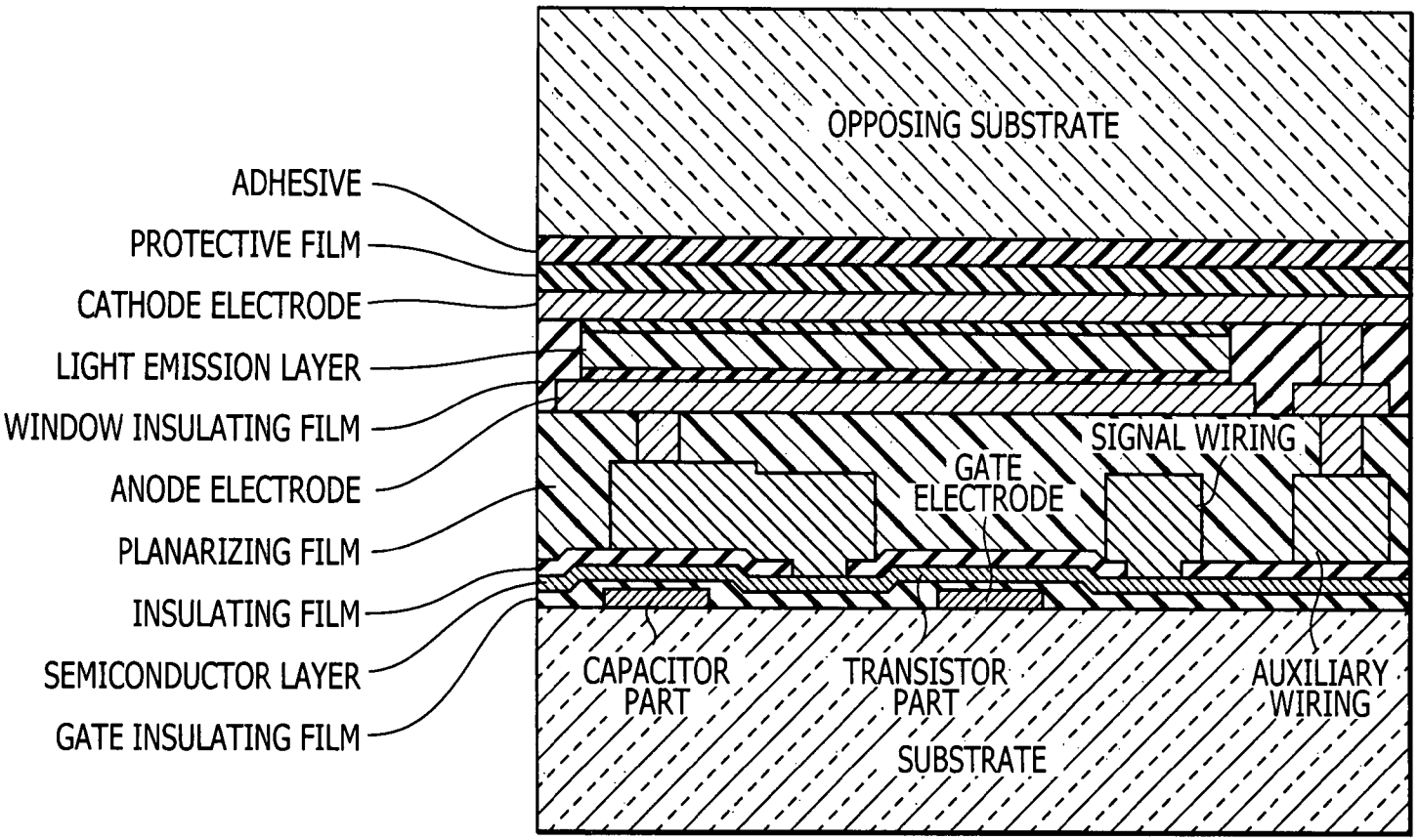
FIG. 12 is a cross sectional view showing the structure of a display device of an embodiment of the present invention.

A display device of an embodiment of the present invention has a thin film device structure such, as shown in FIG. 12. FIG. 12 shows the schematic cross sectional structure of a pixel formed on an insulating substrate. As shown in FIG. 12, the pixel is constituted of a transistor part including a plurality of thin film transistors (in FIG. 12, one TFT is shown illustratively), a capacitor part, such as a holding capacitor, and a light emission part, such as an organic EL element. The transistor part and capacitor part are formed on the substrate by TFT processes, and the light emission part, such as an organic EL element, is stacked thereon. A transparent opposing substrate is adhered thereon with adhesive to form a flat panel.

Figure 13:
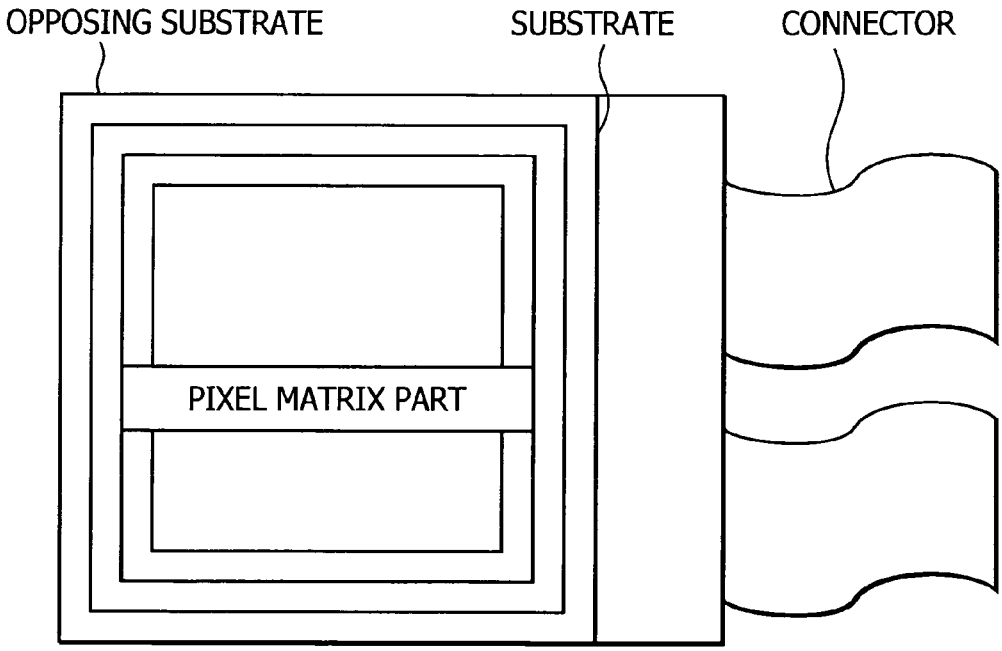
FIG. 13 is a plan view showing the module structure of a display device of an embodiment of the present invention.

A display device of an embodiment of the present invention includes a flat module type, such as shown in FIG. 13. For example, a pixel array part (pixel matrix part) is formed by integrating pixels made of organic EL elements, thin film transistors and thin film capacitors in a matrix shape on an insulating substrate, and an opposing substrate made of glass or the like is adhered to the pixel array part (pixel matrix part) by coating adhesive on a peripheral area of the pixel array part to form a display module. If necessary, color filters, protecting films, and light shielding films may be disposed on the transparent opposing substrate. A flexible print circuit (FPC) may be disposed on the display module as a connector for the input/output of signals and the like to the pixel array part from the exterior.

A display device of the embodiment of the present invention described above has a flat panel shape and is applicable to the display of an electronic apparatus in various fields for displaying images or pictures of video signals input to or generated in the electronic apparatus, including a digital camera, a note type personal computer, a mobile phone, a video camera and the like. Examples of an electronic apparatus adopting the display of this type will be described.

Figure 14:
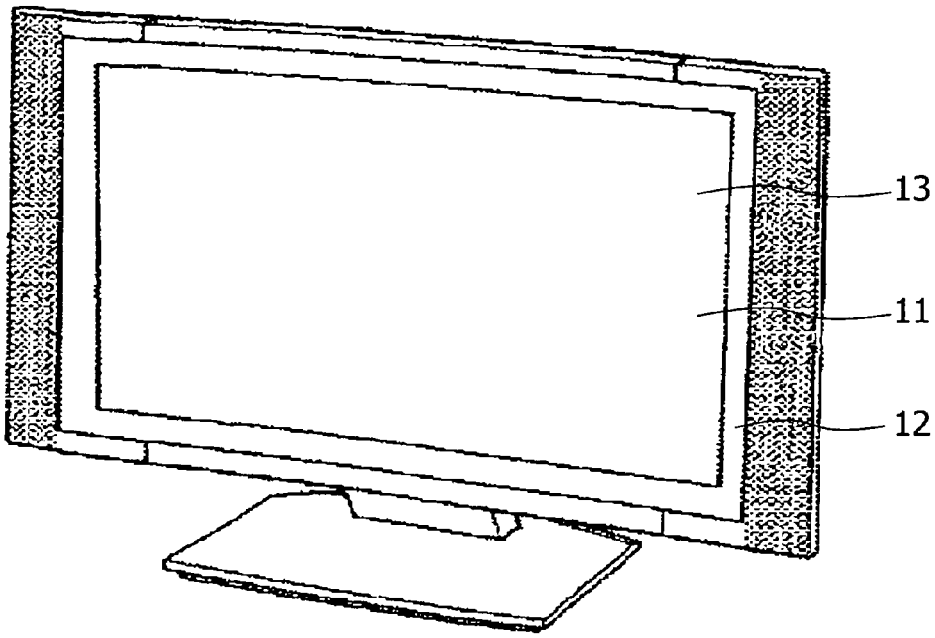
FIG. 14 is a perspective view of a television set equipped with the display device of an embodiment the present invention.

FIG. 14 shows a television receiver adopting an embodiment of the present invention. The television receiver includes a video display screen 11 constituted of a front panel 12, a filter glass 13 and the like, and it is manufactured by using the display device of an embodiment of the present invention as the video display screen 11.

Figure 15:
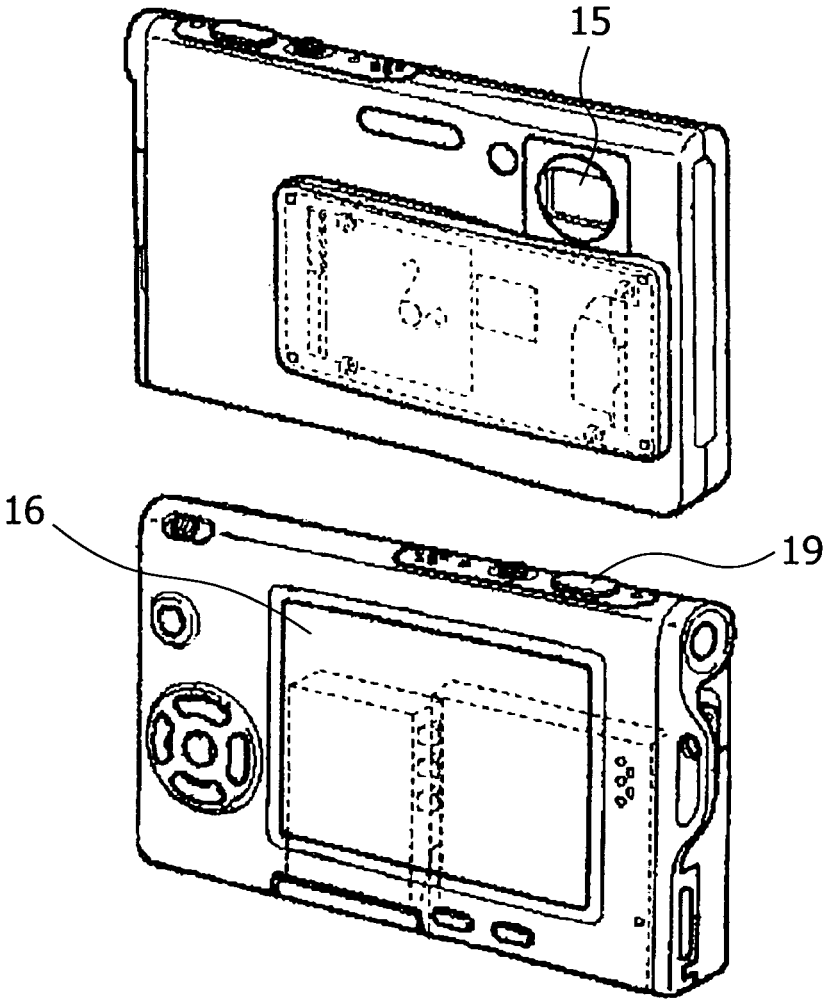
FIG. 15 is a perspective view of a digital still camera equipped with the display device of an embodiment of the present invention.

FIG. 15 shows a digital camera adopting an embodiment of the present invention. The upper figure is a front view and the lower figure is a back view. The digital camera includes a taking lens, a flash emission part 15, a display part 16, control switches, menu switches, a shutter 19 and the like, and it is manufactured by using the display device of an embodiment of the present invention as the display part 16.

Figure 16:
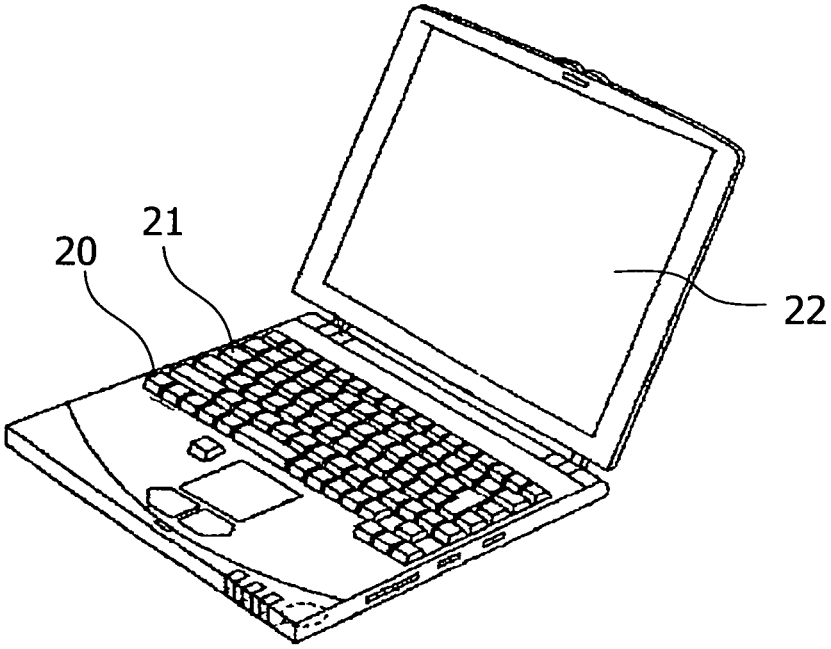
FIG. 16 is a perspective view of a note type personal computer equipped with the display device of an embodiment of the present invention.

FIG. 16 shows a note type personal computer adopting an embodiment of the present invention. A main body 20 includes a keyboard 21 to be operated when characters and the like are input, and a main body cover includes a display part 22 for displaying images. The note type personal computer is manufactured by using the display device of an embodiment of the present invention as the display part 22.

Figure 17:
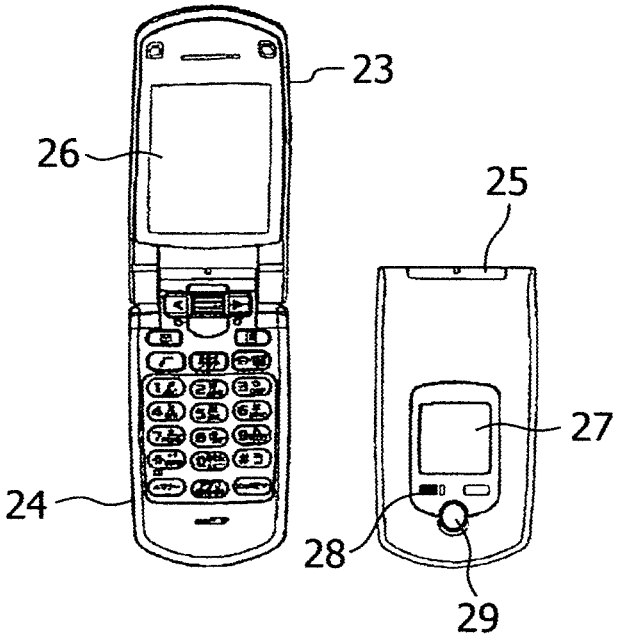
FIG. 17 is a schematic diagram showing a portable terminal apparatus equipped with the display device of an embodiment of the present invention.

FIG. 17 shows a mobile terminal apparatus adopting an embodiment of the present invention. The left figure shows an open state, and the right figure shows a closed state. The mobile terminal apparatus includes an upper housing 23, a lower housing 24, a coupling part (hinge) 25, a display 26, a sub display 27, a picture light 28, a camera 29 and the like, and it is manufactured by using the display device of an embodiment of the present invention as the display 26 and the sub display 27.

Figure 18:
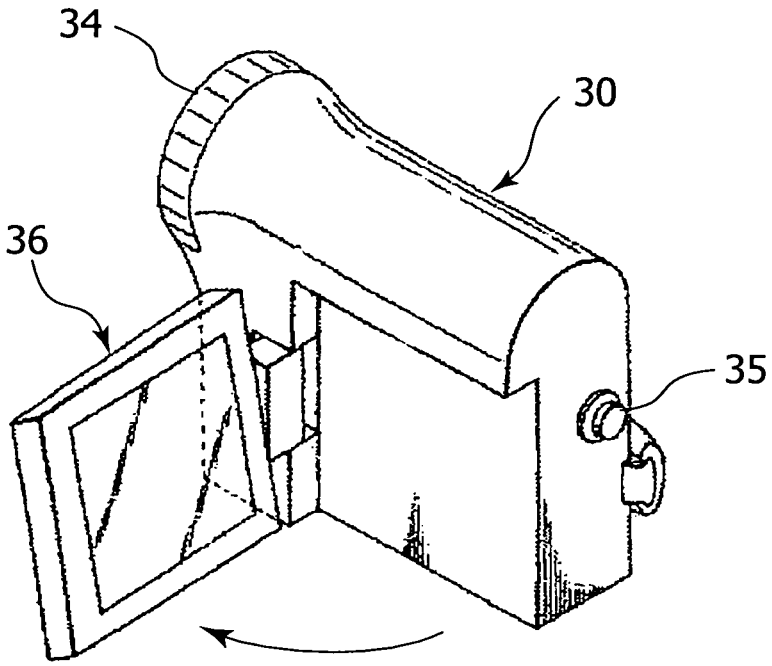
FIG. 18 is a perspective view of a video camera equipped with the display device of an embodiment of the present invention.

FIG. 18 shows a video camera adopting an embodiment of the present invention. The video camera includes a main part 30, an object taking lens 34 disposed on the front side, a photographing start/stop switch 35, a monitor 36 and the like, and it is manufactured by using the display device of an embodiment of the present invention as the monitor 36.

It should be understood by those skilled in the art that various modifications, combinations, sub combinations and alternations may occur depending on design requirements and other factors insofar as they are within the scope of the appended claims or the equivalents thereof.

What is claimed is:

1. A display device comprising:

a pixel array unit including a plurality of pixels, and power supply lines; and a power supply scanner for supplying a power supply voltage switching between first and second potentials to each of the power supply lines, wherein a given one of the plurality of pixels includes a light emitting element, a sampling transistor, a driver transistor, and a holding capacitor, wherein the sampling transistor samples a signal potential to be held in the holding capacitor, the driver transistor receives a supply of a current from the power supply scanner through one of the power supply lines at the first potential and flows a drive current to the light emitting element in accordance with the held signal potential, and the power supply scanner changes the one of the power supply lines from the first potential to the second potential before the sampling transistor samples the signal potential.

2. An electronic apparatus equipped with the display device recited in claim 1.

3. A method of driving a display device comprising a pixel array unit including a plurality of pixels, and power supply lines, and a power supply scanner for supplying a power supply voltage switching between first and second potentials to each of the power supply lines, wherein a given one of the plurality of pixels includes a light emitting element, a sampling transistor, a driver transistor, and a holding capacitor, the method comprising:

sampling, by the sampling transistor, a signal potential to be held in the holding capacitor;

receiving, by the driver transistor, a supply of a current from the power supply scanner through one of the power supply lines at the first potential;

flowing, by the driver transistor, a drive current to the light emitting element in accordance with the held signal potential; and changing, by the power supply scanner, the one of the power supply lines from the first potential to the second potential before the sampling transistor samples the signal potential.

4. A display device comprising:

a pixel array unit including a plurality of pixels, and power supply lines; and a power supply scanner for supplying a power supply voltage switching between first and second potentials to each of the power supply lines, wherein a given one of the plurality of pixels includes a light emitting element, a sampling transistor, a driver transistor, and a holding capacitor, wherein the sampling transistor samples a signal potential to be held in the holding capacitor, the driver transistor receives a supply of a current from the power supply scanner through one of the power supply lines at the first potential and flows a drive current to the light emitting element in accordance with the held signal potential, and the power supply scanner causes the light emitting element to stop emitting light by changing the one of the power supply lines from the first potential to the second potential before the sampling transistor samples the signal potential.

5. The display device of claim 4, wherein:

the power supply scanner changes the one of the power supply lines from the first potential to the second potential at a first timing, the sampling transistor samples the signal potential at a second timing, and the power supply scanner changes the one of the power supply lines from the second potential to the first potential at a third timing subsequent to the second timing, the signal potential during a time period from the second timing to the third timing is a reference potential, and the signal potential at a fourth timing subsequent to the third timing is a video signal potential.

6. A display device comprising:

a pixel array unit including a plurality of pixels, and power supply lines; and a control unit including a power supply scanner for supplying a power supply voltage switching between first and second potentials to each of the power supply lines, wherein a given one of the plurality of pixels includes a light emitting element, a sampling transistor, a driver transistor, and a holding capacitor, wherein the sampling transistor samples a signal potential to be held in the holding capacitor, the driver transistor receives a supply of a current from the power supply scanner through one of the power supply lines at the first potential and flows a drive current to the light emitting element in accordance with the held signal potential, the control unit performs a threshold correction operation of causing the holding capacitor to hold a threshold voltage of the driver transistor, and the power supply scanner changes the one of the power supply lines from the first potential to the second potential before the control unit performs the threshold correction operation.

7. The display device of claim 6, wherein:

the power supply scanner changes the one of the power supply lines from the first potential to the second potential at a first timing, the sampling transistor samples the signal potential at a second timing subsequent to the first timing, and the power supply scanner changes the one of the power supply lines from the second potential to the first potential at a third timing subsequent to the second timing, and the threshold correction operation begins at the third timing.

8. The display device of claim 7, wherein:

the signal potential during a time period from the second timing to the third timing and during performance of the threshold correction operation is a reference potential, and the signal potential at a fourth timing that is subsequent to completion of the threshold correction operation is a video signal potential.

* * * * *